US009035241B2

(12) United States Patent
Giles

(10) Patent No.: US 9,035,241 B2
(45) **Date of Patent: *May 19, 2015**

(54) ION GUIDING DEVICE

(71) Applicant: Micromass UK Limited, Manchester (GB)

(72) Inventor: Kevin Giles, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/076,627

(22) Filed: Nov. 11, 2013

(65) Prior Publication Data

US 2014/0131565 A1 May 15, 2014

Related U.S. Application Data

(63) Continuation of application No. 12/679,139, filed as application No. PCT/GB2008/003198 on Sep. 22, 2008, now Pat. No. 8,581,181.

(60) Provisional application No. 60/988,107, filed on Nov. 15, 2007.

(30) Foreign Application Priority Data

Sep. 21, 2007 (GB) ..... 0718468.2

(51) Int. Cl.
*H01J 49/06* (2006.01)
*H01J 49/26* (2006.01)

(52) U.S. Cl.
CPC ..... *H01J 49/062* (2013.01); *H01J 49/26* (2013.01)

(58) Field of Classification Search
USPC ..... 250/283
See application file for complete search history.

(56) References Cited

U.S. PATENT DOCUMENTS

| | | | | |
|---|---|---|---|---|
| 5,576,540 | A | 11/1996 | Jolliffe | |
| 5,811,820 | A | 9/1998 | Kirchner et al. | |
| 6,674,071 | B2 | 1/2004 | Franzen et al. | |
| 6,891,157 | B2 | 5/2005 | Bateman et al. | |
| 7,157,698 | B2 | 1/2007 | Makarov et al. | |
| 7,358,488 | B2 | 4/2008 | Chernushevich et al. | |
| 7,459,678 | B2 | 12/2008 | Schoen | |
| 7,459,679 | B2 | 12/2008 | Lobada | |
| 7,507,953 | B2 | 3/2009 | Makarov et al. | |
| 7,718,959 | B2 | 5/2010 | Franzen et al. | |
| 7,847,243 | B2 | 12/2010 | Makarov et al. | |
| 7,919,747 | B2 | 4/2011 | Green et al. | |
| 8,288,714 | B2 | 10/2012 | Makarov et al. | |
| 8,384,027 | B2 * | 2/2013 | Hoyes et al. | 250/292 |

(Continued)

FOREIGN PATENT DOCUMENTS

| | | |
|---|---|---|
| JP | 1097838 | 4/1998 |
| JP | 3663716 | 6/2005 |

(Continued)

*Primary Examiner* — Phillip A Johnston
(74) *Attorney, Agent, or Firm* — Diederiks & Whitelaw, PLC

(57) ABSTRACT

An ion guiding device is disclosed comprising a first ion guide which is conjoined with a second ion guide. Ions are urged across a radial pseudo-potential barrier which separates the two guiding regions by a DC potential gradient. Ions may be transferred from an ion guide which has a relatively large cross-sectional profile to an ion guide which has a relatively small cross-sectional profile in order to improve the subsequent ion confinement of the ions.

24 Claims, 10 Drawing Sheets

(56) References Cited

U.S. PATENT DOCUMENTS

| | | | | |
|---|---|---|---|---|
| 8,581,181 | B2 * | 11/2013 | Giles | 250/283 |
| 8,581,182 | B2 * | 11/2013 | Giles | 250/283 |
| 8,581,185 | B2 | 11/2013 | Makarov et al. | |
| 2004/0026614 | A1 | 2/2004 | Bateman et al. | |
| 2004/0188605 | A1 | 9/2004 | Tang et al. | |
| 2005/0279931 | A1 | 12/2005 | Franzen et al. | |
| 2006/0284080 | A1 * | 12/2006 | Makarov et al. | 250/290 |
| 2008/0067349 | A1 * | 3/2008 | Moskovets et al. | 250/287 |
| 2008/0087813 | A1 * | 4/2008 | Loucks et al. | 250/287 |
| 2008/0265154 | A1 * | 10/2008 | Cousins et al. | 250/288 |
| 2009/0014641 | A1 | 1/2009 | Bateman et al. | |
| 2009/0072136 | A1 | 3/2009 | Pringle et al. | |
| 2011/0180704 | A1 | 7/2011 | Green et al. | |
| 2011/0315873 | A1 | 12/2011 | Makarov et al. | |

FOREIGN PATENT DOCUMENTS

| | | |
|---|---|---|
| JP | 4097695 | 6/2008 |
| JP | 2009532822 | 9/2009 |
| WO | 2007030923 | 3/2007 |
| WO | 2007071991 | 6/2007 |

* cited by examiner

ION GUIDING DEVICE

CROSS REFERENCE TO RELATED APPLICATIONS

This application is a continuation of U.S. patent application Ser. No. 12/679,139 filed Sep. 8, 2010, which is the National Stage of International Application No. PCT/GB2008/003198, filed Sep. 22, 2008, which claims benefit of and priority to U.S. Provisional Patent Application No. 60/988,107, filed on Nov. 15, 2007 and United Kingdom Application No 0718468.2 which was filed on Sep. 21, 2007. The contents of these applications are expressly incorporated herein by reference in their entirety.

BACKGROUND OF THE INVENTION

The present invention relates to an ion guiding device. The preferred embodiment relates to a mass spectrometer, a device for guiding ions, a method of mass spectrometry and a method of guiding ions.

Ion guides are known wherein ions are confined or constrained to flow along the central longitudinal axis of a linear ion guide. The central axis of the ion guide is coincident with the centre of a radially symmetric pseudo-potential valley. The pseudo-potential valley is formed within the ion guide as a result of applying RF voltages to the electrodes comprising the ion guide. Ions enter and exit the ion guide along the central longitudinal axis of the ion Guide.

It is desired to provide an improved ion guide and method of guiding ions.

SUMMARY OF THE INVENTION

According to an aspect of the present invention there is provided an ion guiding device comprising:

a first ion guide comprising a first plurality of electrodes, each electrode comprising at least one aperture through which ions are transmitted in use wherein a first ion guiding path is, formed along or within the first ion guide;

a second ion guide comprising a second plurality of electrodes, each electrode comprising at least one aperture through which ions are transmitted in use wherein a second different ion guiding path is formed along or within the second ion guide;

a first device arranged and adapted to create one or more pseudo-potential barriers at one or more points along the length of the ion guiding device between the first ion guiding path and the second ion guiding path; and a second device arranged and adapted to transfer ions from the first ion guiding path into the second ion guiding path by urging ions across the one or more pseudo-potential barriers.

Ions are preferably transferred radially or with a non-zero radial component of velocity across one or more radial or longitudinal pseudo-potential barriers disposed between the first ion guide and the second ion guide which are preferably substantially parallel to one another.

Embodiments of the present invention are contemplated wherein ions are transferred from the first ion guide to the second ion guide and/or from the second ion guide to the first ion guide multiple times or at least 2, 3, 4, 5, 6, 7, 8, 9 or 10 times. Ions may, for example, be repeatedly switched back and forth between the two or more ion guides.

According to an embodiment either:

(a) at least 1%, 5%, 10%, 20%, 30%, 40%, 50%, 60%, 70%, 80%, 90%, 95% or 100% of the first plurality of electrodes and/or the second plurality of electrodes have substantially circular, rectangular, square or elliptical apertures; and/or (b) at least 1%, 5%, 10%, 20%, 30%, 40%, 50%, 60%, 70%, 80%, 90%, 95% or 100% of the first plurality of electrodes and/or the second plurality of electrodes have apertures which are substantially the same size or which have substantially the same area; and/or (c) at least 1%, 5%, 10%, 20%, 30%, 40%, 50%, 60%, 70%, 80%, 90%, 95% or 100% of the first plurality of electrodes and/or the second plurality of electrodes have apertures which become progressively larger and/or smaller in size or in area in a direction along the axis or length of the first ion guide and/or the second ion guide; and/or (d) at least 1%, 5%, 10%, 20%, 30%, 40%, 50%, 60%, 70%, 80%, 90%, 95% or 100% of the first plurality of electrodes and/or the second plurality of electrodes have apertures having internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm; and/or (e) at least 1%, 5%, 10%, 20%, 30%, 40%, 50%, 60%, 70%, 80%, 90%, 95% or 100% of the first plurality of electrodes and/or the second plurality of electrodes are spaced apart from one another by an axial distance selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm; and/or (f) at least at least 1%, 5%, 10%, 20%, 30%, 40%, 50%, 60%, 70%, 80%, 90%, 95% or 100% of the first plurality of electrodes and/or the second plurality of electrodes comprise apertures wherein the ratio of the internal diameter or dimension of the apertures to the centre-to-centre axial spacing between adjacent electrodes is selected from the group consisting of (i) <1.0; (ii) 1.0-1.2; (iii) 1.2-1.4; (iv) 1.4-1.6; (v) 1.6-1.8; (vi) 1.8-2.0; (vii) 2.0-2.2; (viii) 2.2-2.4; (ix) 2.4-2.6; (x) 2.6-2.8; (xi) 2.8-3.0; (xii) 3.0-3.2; (xiii) 3.2-3.4; (xiv) 3.4-3.6; (xv) 3.6-3.8; (xvi) 3.8-4.0; (xvii) 4.0-4.2; (xviii) 4.2-4.4; (xix) 4.4-4.6; (xx) 4.6-4.8; (xxi) 4.8-5.0; and (xxii) >5.0; and/or (g) at least 1%, 5%, 10%, 20%, 30%, 40%, 50%, 60%, 70%, 80%, 90%, 95% or 100% of the first plurality of electrodes and/or the second plurality of electrodes have a thickness or axial length selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm; and/or (h) the first plurality of electrodes have a first cross-sectional area or profile, wherein the first cross-sectional area or profile changes, increases, decreases or varies along at least at least 1%, 5%, 10%, 20%, 30%, 40%, 50%, 60%, 70%, 80%, 90%, 95% or 100% of the length of the first ion guide; and/or (i) the second plurality of electrodes have a second cross-sectional area or profile, wherein the second cross-sectional area or profile changes, increases, decreases or varies along at least at least 1%, 5%, 10%, 20%, 30%, 40%, 50%, 60%, 70%, 80%, 90%, 95% or 100% of the length of the second ion guide.

According to an aspect of the present invention there is provided an ion guiding device comprising:

a first on guide comprising a first plurality of electrodes comprising one or more first rod sets wherein a first ion guiding path is formed along or within the first ion guide;

a second ion guide comprising a first plurality of electrodes comprising one or more second rod sets wherein a second different ion guiding path is formed along or within the second ion guide;

a first device arranged and adapted to create one or more pseudo-potential barriers at one or more points along the length of the ion guiding device between the first ion guiding path and the second ion guiding path; and a second device arranged and adapted to transfer ions from the first ion guiding path into the second ion guiding path by urging ions across the one or more pseudo-potential barriers.

Ions are preferably transferred radially or with a non-zero radial component of velocity across one or more radial or longitudinal pseudo-potential barriers disposed between the first ion guide and the second ion guide which are preferably substantially parallel to one another.

According to an embodiment:

(a) the first ion guide and/or the second ion guide comprise one or more axially segmented rod, set ion guides; and/or (b) the first ion guide and/or the second ion guide comprise one or more segmented quadrupole, hexapole or octapole ion guides or an ion guide comprising four or more segmented rod sets; and/or (c) the first ion guide and/or the second ion guide comprise a plurality of electrodes having a cross-section selected from the group consisting of (i) an approximately or substantially circular cross-section; (ii) an approximately or substantially hyperbolic surface; (iii) an arcuate or part-circular cross-section; (iv) an approximately or substantially rectangular cross-section; and (v) an approximately or substantially square cross-section; and/or (d) the first ion guide and/or the second ion guide comprise further comprise a plurality of ring electrodes arranged around the one or more first rod sets and/or the one or more second rod sets; and/or (e) the first ion guide and/or the second ion guide comprise 4, 5, 6, 7, 8, 9, 10, 11, 12, 13, 14, 15, 16, 17, 18, 19, 20, 21, 22, 23, 24, 25, 26, 27, 28, 29, 30 or >30 rod electrodes.

Adjacent or neighbouring rod electrodes are preferably maintained at opposite phase of an AC or RF voltage.

According to an aspect of the present invention there is provided an ion guiding device comprising:

a first ion guide comprising a first plurality of electrodes arranged in a plane in which ions travel in use and wherein a first ion guiding path is formed along or within the first ion guide;

a second ion guide comprising a second plurality of electrodes arranged in a plane in which ions travel in use wherein a second different ion guiding path is formed along or within the second ion guide;

a device arranged and adapted to create a pseudo-potential barrier at one or more points along the length of the ion guiding device between the first ion guiding path and the second ion guiding path; and a device arranged and adapted to transfer ions from the first ion guiding path into the second ion guiding path by urging ions across the pseudo-potential barrier.

Ions are preferably transferred radially or with a non-zero radial component of velocity across one or more radial or longitudinal pseudo-potential barriers disposed between the first ion guide and the second ion guide which are preferably substantially parallel to one another.

According to an embodiment:

(a) the first ion guide and/or the second ion guide comprises a stack or array of planar, plate, mesh or curved electrodes, wherein the stack or array of planar, plate, mesh or curved electrodes comprises a plurality or at least 2, 3, 4, 5, 6, 7, 8, 9, 10, 11, 12, 13, 14, 15, 16, 17, 18, 19 or 20 planar, plate, mesh or curved electrodes and wherein at least 1%, 5%, 10%, 15%, 20%, 25%, 30%, 35%, 40%, 45%, 50%, 55%, 60%, 65%, 70%, 75%, 80%, 85%, 90%, 95% or 100% of the planar, plate, mesh or curved electrodes are arranged generally in the plane in which ions travel in use; and/or (b) the first ion guide and/or the second ion guide are axially segmented so as to comprise at least 2, 3, 4, 5, 6, 7, 8, 9, 10, 11, 12, 13, 14, 15, 16, 17, 18, 19 or 20 axial segments, wherein at least 1%, 5%, 10%, 20%, 30%, 40%, 50%, 60%, 70%, 80%, 90%, 95% or 100% of the first plurality of electrodes in an axial segment and/or at least 1%, 5%, 10%, 20%, 30%, 40%, 50%, 60%, 70%, 80%, 90%, 95% or 100% of the second plurality of electrodes in an axial segment are maintained in use at the same DC voltage.

The first device is preferably arranged and adapted to create:

(i) one or more radial or longitudinal pseudo-potential barriers at one or more points along the length of the on guiding device between the first ion guiding path and the second ion guiding path; and/or (ii) one or more non-axial pseudo-potential barriers at one or more points along the length of the ion guiding device between the first ion guiding path and the second ion guiding path.

The second device is preferably arranged and adapted:

(a) to transfer ions radially from the first ion guiding path into the second ion guiding path; and/or (b) to transfer ions with a non-zero radial component of velocity and an axial component of velocity from the first ion guiding path into the second ion guiding path; and/or (c) to transfer ions with a non-zero radial component of velocity and an axial component of velocity from the first ion guiding path into the second ion guiding path, wherein the ratio of the radial component of velocity to the axial component of velocity is selected from the group consisting of (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1.0-1.1; (xii) 1.1-1.2; (xiii) 1.2-1.3; (xiv) 1.3-1.4; (xv) 1.4-1.5; (xvi) 1.5-1.6; (xvii) 1.6-1.7; (xviii) 1.7-1.8; (xix) 1.8-1.9; (xx) 1.9-2.0; (xxi) 2.0-3.0; (xxii) 3.0-4.0; (xxiii) 4.0-5.0; (xxiv) 5.0-6.0; (xxv) 6.0-7.0; (xxvi) 7.0-8.0; (xxvii) 8.0-9.0; (xxviii) 9.0-10.0; and (xxix) >10.0;

(d) to transfer ions from the first ion guiding path into the second ion guiding path by transferring ions across one or more radial pseudo-potential barriers arranged between the first ion guiding path and the second ion guiding path.

Ions are preferably transferred between the two preferably parallel ion guides in a manner which is different to transferring ions between two ion guides arranged in series. With two ion guides arranged in series ions are not transferred radially or across a radial or longitudinal pseudo-potential barrier as is the subject of the preferred embodiment.

According to an embodiment;

(a) the first ion guide and the second ion guide are conjoined, merged, overlapped or open to one another for at least 1%, 5%, 10%, 20%, 30%, 40%, 50%, 60%, 70%, 80%, 90%, 95% or 100% of the length of the first ion guide and/or the second ion guide; and/or (b) ions may be transferred radially between the first ion guide or the first ion guiding path and the second ion guide or the second ion guiding path over at least 1%, 5%, 10%, 20%, 30%, 40%, 50%, 60%, 70%, 80%, 90%, 95% or 100% of the length of the first ion guide and/or the second ion guide; and/or (c) one or more radial or longitudinal pseudo-potential barriers are formed, in use, which separate the first ion guide or the first ion guiding path from the second ion guide or the second ion guiding path along at least 1%, 5%, 10%, 20%, 30%, 40%, 50%, 60%, 70%, 80%, 90%, 95% or 100% of the length of the first ion guide and/or the second ion guide; and/or (d) a first pseudo-potential valley or field is formed within the first ion guide and a second pseudo-potential valley or field is formed within the second ion guide and wherein a pseudo-potential barrier separates the first pseudo-potential valley from the second pseudo-potential valley, wherein ions are confined radially within the ion guiding device by either the first pseudo-potential valley or the second pseudo-potential valley and wherein at least some ions are urged or caused to transfer across the pseudo-potential barrier; and/or (e) the degree of overlap or openness between the first ion guide and the second ion guide remains constant or varies, increases, decreases, increases in a stepped or linear manner or decreases in a stepped or linear manner along the length of the first and second ion guides.

According to an embodiment;

(a) one or more or at least 1%, 5%, 10%, 20%, 30%, 40%, 50%, 60%, 70%, 80%, 90%, 95% or 100% of the first plurality of electrodes are maintained in a mode of operation at a first potential or voltage selected from the group consisting of (i) ±0-10 V; (ii) ±10-20 V; (iii) ±20-30 V; (iv) ±30-40 V; (v) ±40-50 V; (vi) ±50-60 V; (vii) ±60-70 V; (viii) ±70-80 V; (ix) ±80-90 V; (x) ±90-100 V; (xi) ±100-150 V; (xii) ±150-200 V (xiii) ±200-250 V; (xiv) ±250-300 V; (xv) ±300-350 V; (xvi) ±350-400 V; (xvii) ±400-450 V; (xviii) ±450-500 V; (xix) ±500-550 V; (xx) ±550-600 V; (xxi) ±600-650 V; (xxii) ±650-700 V; (xxiii) ±700-750 V; (xxiv) ±750-800 V; (xxv) ±800-850 V; (xxvi) ±850-900 V; (xxvii) ±900-950 V; (xxviii) ±950-1000 V; and (xxix) >±1000 V; and/or (b) one or more or at least 1%, 5%, 10%, 20%, 30%, 40%, 50%, 60%, 70%, 80%, 90%, 95% or 100% of the second plurality of electrodes are maintained in a mode of operation at a second potential or voltage selected from the group consisting of (i) ±0-10 V; (ii) ±10-20 V; (iii) ±20-30 V; (iv) ±30-40 V; (v) ±40-50 V; (vi) ±50-60 V; (vii) ±60-70 V; (viii) ±70-80 V; (ix) ±80-90 V; (x) ±90-100 V; (xi) ±100-150 V; (xii) ±150-200 V; (xiii) ±200-250 V; (xiv) ±250-300 V; (xv) ±300-350 V; (xvi) ±350-400 V; (xvii) ±400-450 V; (xviii) ±450-500 V; (xix) ±500-550 V; (xx) ±550-600 V; (xxi) ±600-650 V; (xxii) ±650-700 V; (xxiii) ±700-750 V; (xxiv) ±750-800 V; (xxv) ±800-850 V; (xxvi) ±850-900 V; (xxvii) ±900-950 V; (xxviii) ±950-1000 V; and (xxix) >±1000 V; and/or (c) a potential difference is maintained in a mode of operation between one or more or at least 1%, 5%, 10%, 20%, 30%, 40% 50%, 60%, 70%, 80%, 90%, 95% or 100% of the first plurality of electrodes and one or more or at least 1%, 5%, 10%, 20%, 30%, 40%, 50%, 60%, 70%, 80%, 90%, 95% or 100% of the second plurality of electrodes, wherein the potential difference is selected from the group consisting of (i) ±0-10 V; (ii) ±10-20 V; (iii) ±20-30 V; (iv) ±30-40 V; (v) ±40-50 V; (vi) ±50-60 V; (vii) ±60-70 V; (viii) ±70-80 V; (ix) ±80-90 V; (x) ±90-100 V; (xi) ±100-150 V; (xii) ±150-200 V; (xiii) ±200-250 V; (xiv) ±250-300 V; (xv) ±300-350 V; (xvi) ±350-400 V; (xvii) ±400-450 V; (xviii) ±450-500 V; (xix) ±500-550 V; (xx) ±550-600 V; (xxi) ±600-650 V; (xxii) ±650-700 V; (xxiii) ±700-750 V; (xxiv) ±750-800 V; (xxv) ±800-850 V; (xxvi) ±850-900 V; (xxvii) ±900-950 V; (xxviii) ±950-1000 V; and (xxix) >±1000 V; and/or (d) the first plurality of electrodes or at least 1%, 5%, 10%, 20%, 30%, 40%, 50%, 60%, 70%, 80%, 90%, 95% or 100% of the first plurality of electrodes are maintained in use at substantially the same first DC voltage; and/or (e) the second plurality of electrodes or at least 1%, 5%, 10%, 20%, 30%, 40%, 50%, 60%, 70%, 80%, 90%, 95% or 100% of the second plurality of electrodes are maintained in use at substantially the same second DC voltage; and/or (f) at least 1%, 5%, 10%, 20%, 30%, 40%, 50%, 60%, 70%, 80%, 90%, 95% or 100% of the first plurality of electrodes and/or the second plurality of electrodes are maintained at substantially the same DC or DC bias voltage or are maintained at substantially different DC or DC bias voltages.

The first ion guide preferably comprises a first central longitudinal axis and the second ion guide preferably comprises a second central longitudinal axis wherein:

(i) the first central longitudinal axis is substantially parallel with the second central longitudinal axis for at least 1%, 5%, 10%, 20%, 30%, 40%, 50%, 60%, 70%, 80%, 90%, 95% or 100% of the length of the first ion guide and/or the second ion guide; and/or (ii) the first central longitudinal axis is not co-linear or co-axial with the second central longitudinal axis for at least 1%, 5%, 10%, 20%, 30%, 40%, 50%, 60%, 70%, 80%, 90%, 95% or 100% of the length of the first ion guide and/or the second ion guide; and/or (iii) the first central longitudinal axis is spaced at a constant distance or remains equidistant from the second central longitudinal axis for at least 1%, 5%, 10%, 20%, 30%, 40%, 50%, 60%, 70%, 80%, 90%, 95% or 100% of the length of the first ion guide and/or the second ion guide; and/or (iv) the first central longitudinal axis is a mirror image of the second central longitudinal axis for at least 1%, 5%, 10%, 20%, 30%, 40%, 50%, 60%, 70%, 80%, 90%, 95% or 100% of the length of the first ion guide and/or the second ion guide; and/or (v) the first central longitudinal axis substantially tracks, follows, mirrors or runs parallel to and/or alongside the second central longitudinal axis for at least 1%, 5%, 10%, 20%, 30%, 40%, 50%, 60%, 70%, 80%, 90%, 95% or 100% of the length of the first ion guide and/or the second ion guide; and/or (vi) the first central longitudinal axis converges towards or diverges away from the second central longitudinal axis for at least 1%, 5%, 10%, 20%, 30%, 40%, 50%, 60%, 70%, 80%, 90%, 95% or 100% of the length of the first ion guide and/or the second ion guide; and/or (vii) the first central longitudinal axis and the second central longitudinal form a X-shaped or Y-shaped coupler or splitter ion guiding path; and/or (viii) one or more crossover regions, sections or junctions are arranged between the first ion guide and the second ion guide wherein at least some ions may be transferred or are caused to be transferred from the first ion guide into the second ion guide and/or wherein at least some ions may be transferred from the second ion guide into the first ion guide.

In use a first pseudo-potential valley is preferably formed within the first ion guide such that the first pseudo-potential valley has a first longitudinal axis and likewise in use a second pseudo-potential valley is preferably formed within the second ion guide such that the second pseudo-potential valley has a second longitudinal axis, wherein:

(i) the first longitudinal axis is substantially parallel with the second longitudinal axis for at least 1%, 5%, 10%, 20%, 30%, 40%, 50%, 60%, 70%, 80%, 90%, 95% or 100% of the length of the first ion guide and/or the second ion guide; and/or (ii) the first longitudinal axis is not co-linear or co-axial with the second longitudinal axis for at least 1%, 5%, 10%, 20%, 30%, 40%, 50%, 60%, 70%, 80%, 90%, 95% or 100% of the length of the first ion guide and/or the second on guide; and/or (iii) the first longitudinal axis is spaced at a constant distance or remains equidistant from the second longitudinal axis for at least 1%, 5%, 10%, 20%, 30%, 40%, 50%, 60%, 70%, 80%, 90%, 95% or 100% of the length of the first ion guide and/or the second ion guide; and/or (iv) the first longitudinal axis is a mirror image of the second longitudinal axis for at least 1%, 5%, 10%, 20%, 30%, 40%, 50%, 60%, 70%, 80%, 90%, 95% or 100% of the length of the first ion guide and/or the second ion guide; and/or (v) the first longitudinal axis substantially tracks, follows, mirrors or runs parallel to and/or alongside the second longitudinal axis for at least 1%, 5%, 10%, 20%, 30%, 40%, 50%, 60%, 70%, 80%, 90%, 95% or 100% of the length of the first ion guide and/or the second ion guide; and/or (vi) the first longitudinal axis converges towards or diverges away from the second longitudinal axis for at least 1%, 5%, 10%, 20%, 30%, 40%, 50%, 60%, 70%, 80%, 90%, 95% or 100% of the length of the first ion guide and/or the second ion guide; and/or (vii) the first longitudinal axis and the second longitudinal form a X-shaped or Y-shaped coupler or splitter ion guiding path; and/or (viii) one or more crossover regions, sections or junctions are arranged between the first ion guide and the second ion guide wherein at least some ions may be transferred or are caused to be transferred from the first ion guide into the second ion guide and/or wherein at least some ions may be transferred from the second ion guide into the first on guide.

According to an embodiment:

(a) the first ion guide comprises an ion guiding region having a first cross-sectional area and the second ion guide comprises an ion guiding region having a second cross-sectional area, wherein the first and second cross-sectional areas are substantially the same or substantially different; and/or (b) the first ion guide comprises an ion guiding region having a first cross-sectional area and the second ion guide campuses an ion guiding region having a second cross-sectional area, wherein the ratio of the first cross-sectional area to the second cross-sectional area is selected from the group consisting of (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1.0-1.1; (xii) 1.1-1.2; (xiii) 1.2-1.3; (xiv) 1.3-1.4; (xv) 1.4-1.5; (xvi) 1.5-1.6; (xvii) 1.6-1.7; (xviii) 1.7-1.8; (xix) 1.8-1.9; (xx) 1.9-2.0; (xxi) 2.0-2.5; (xxii) 2.5-3.0; (xxiii) 3.0-3.5; (xxiv) 3.5-4.0; (xxv) 4.0-4.5; (xxvi) 4.5-5.0; (xxvii) 5.0-6.0; (xxviii) 6.0-7.0; (xxix) 7.0-8.0; (xxx) 8.0-9.0 (xxxi) 9.0-10.0; and (xxxii) >10.0; and/or (c) the first ion guide comprises an ion guiding region having a first cross-sectional area or profile, and wherein the first cross-sectional area or profile changes, increases, decreases or varies along at least at least 1%, 5%, 10%, 20%, 30%, 40%, 50%, 60%, 70%, 80%, 90%, 95% or 100% of the length of the first ion guide; and/or (d) the second ion guide comprises an ion guiding region having a second cross-sectional area or profile, and wherein the second cross-sectional area or profile changes, increases, decreases or varies along at least at least 1% 5%, 10%, 20%, 30%, 40%, 50%, 60%, 70%, 80%, 90%, 95% or 100% of the length of the second ion guide; and/or (e) the first on guide comprises a plurality of axial sections and wherein the cross-sectional area or profile of first electrodes in an axial section is substantially the same or different and wherein the cross-sectional area or profile of first electrodes in further axial sections is substantially the same or different; and/or (f) the second ion guide comprises a plurality of axial sections and wherein the cross-sectional area or profile of second electrodes in an axial section is substantially the same or different and wherein the cross-sectional area or profile of second electrodes in further axial sections is substantially the same or different; and/or (g) the first ion guide and/or the second ion guide comprise a substantially constant or uniform cross-sectional area or profile.

The first ion guide and/or the second ion guide preferably comprise:

(i) a first axial segment wherein the first ion guide and/or the second ion guide comprise a first cross-sectional area or profile; and/or (ii) a second different axial segment wherein the first ion guide and/or the second ion guide comprise a second cross-sectional area or profile; and/or (iii) a third different axial segment wherein the first ion guide and/or the second ion guide comprise a third cross-sectional area or profile; and/or (iv) a fourth different axial segment wherein the first ion guide and/or the second ion guide comprise a fourth cross-sectional area or profile;

wherein the first, second, third and fourth cross-sectional area or profiles are substantially the same or different.

The ion guiding device may be arranged and adapted so as to form:

(i) a linear ion guide or ion guiding device; and/or (ii) an open-loop ion guide or ion guiding device; and/or (iii) a closed-loop ion guide or ion guiding device; and/or (iv) a helical, toroidal, part-toroidal, hemitoroidal, semitoroidal or spiral ion guide or ion guiding device; and/or (v) an ion guide or ion guiding device having a curved, labyrinthine, tortuous, serpentine, circular or convoluted ion guide or ion guiding path.

The first ion guide and/or the second ion guide may comprise n axial segments or may be segmented into n separate axial segments, wherein n is selected from the group consisting of: (i) 1-10; (ii) 11-20; (iii) 21-30; (iv) 31-40; (v) 41-50 (vi) 51-60; (vii) 61-70; (viii) 71-80; (ix) 81-90; (x) 91-100; and (xi) >100;

and wherein:

(a) each axial segment comprises 1, 2, 3, 4, 5, 6, 7, 8, 9, 10, 11, 12, 13, 14, 15, 16, 17, 18, 19, 20 or >20 electrodes; and/or (b) the axial length of at least 1%, 5%, 10%, 20%, 30%, 40%, 50%, 60%, 70%, 80%, 90%, 95% or 100% of the axial segments is selected from the group consisting of (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm; and/or (c) the axial spacing between at least 1%, 5%, 10%, 20%, 30%, 40%, 50%, 60%, 70%, 80%, 90%, 95% or 100% of the axial segments is selected from the group consisting of (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm, The first ion guide and/or the second ion guide preferably:

(a) have a length selected from the group consisting of (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm; and/or (b) comprise at least (i) 10-20 electrodes; (ii) 20-30 electrodes; (iii) 30-40 electrodes; (iv) 40-50 electrodes; (v) 50-60 electrodes; (vi) 60-70 electrodes; (vii) 70-80 electrodes; (viii) 80-90 electrodes; (ix) 90-100 electrodes; (x) 100-110 electrodes; (xi) 110-120 electrodes; (xii) 120-130 electrodes; (xiii) 130-140 electrodes; (xiv) 140-150 electrodes; or (xv) >150 electrodes.

The ion guiding device preferably further comprises a first AC or RE voltage supply for applying a first AC or RE voltage to at least some of the first plurality of electrodes and/or the second plurality of electrodes, wherein either:

(a) the first AC or RE voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak; and/or (b) the first AC or RE voltage has a frequency selected from the group consisting of (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz; and/or (c) the first AC or RE voltage supply is arranged to apply the first AC or RE voltage to at least 1%, 5%, 10%, 15%, 20%, 25%, 30%, 35%, 40%, 45%, 50%, 55%, 50%, 65%, 70%, 75%, 80%, 85%, 90%, 95% or 100% of the first plurality of electrodes and/or at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or >50 of the first plurality of electrodes; and/or (d) the first AC or RE voltage supply is arranged to apply the first AC or RE voltage to at least 1%, 5%, 10%, 15%, 20%, 25%, 30%, 35%, 40%, 45%, 50%, 55%, 60%, 65%, 70%, 75%, 80%, 85%, 90%, 95% or 100% of the second plurality of electrodes and/or at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or >50 of the second plurality of electrodes; and/or (e) the first AC or RE voltage supply is arranged to supply adjacent or neighbouring electrodes of the first plurality of electrodes with opposite phases of the first AC or RF voltage; and/or (f) the first AC or RF voltage supply is arranged to supply adjacent or neighbouring electrodes of the second plurality of electrodes with opposite phases of the first AC or RE voltage; and/or (g) the first AC or RE voltage generates one or more radial pseudo-potential wells which act to confine ions radially within the first ion guide and/or the second ion guide.

According to an embodiment the ion guiding device further comprises a third device arranged and adapted to progressively increase, progressively decrease, progressively vary, scan, linearly increase, linearly decrease, increase in a stepped, progressive or other manner or decrease in a stepped, progressive or other manner the amplitude of the first AC or RF voltage by $x_1$ Volts over a time period $t_1$, wherein:

(a) $x_1$ is selected from the group consisting of: (i) <50 V peak to peak; (ii) 50-100 V peak to peak; (iii) 100-150 V peak to peak; (iv) 150-200 V peak to peak, (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak; and/or (b) $t_1$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

According to an embodiment one or more first axial time averaged or pseudo-potential barriers, corrugations or wells are created, in use, along at least 1%, 5%, 10%, 20%, 30%, 40%, 50%, 60%, 70%, 80%, 90% or 95% of the axial length of the first ion guide.

The ion guiding device preferably further comprises a second AC or RF voltage supply for applying a second AC or RF voltage to at least some of the first plurality of electrodes and/or the second plurality of electrodes, wherein either:

(a) the second AC or RF voltage has an amplitude selected from the group consisting of (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak; and/or (b) the second AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz; and/or (c) the second AC or RF voltage supply is arranged to apply the second AC or RF voltage to at least 1%, 5%, 10%, 15%, 20%, 25%, 30%, 35%, 40%, 45%, 50%, 55%, 60%, 65%, 70%, 75%, 80%, 85%, 90%, 95% or 100% of the first plurality of electrodes and/or at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or >50 of the first plurality of electrodes; and/or (d) the first AC or RF voltage supply is arranged to apply the second AC or RF voltage to at least 1%, 5%, 10%, 15%, 20%, 25%, 30%, 35%, 40%, 45%, 50%, 55%, 60%, 65%, 70%, 75%, 80%, 85%, 90%, 95% or 100% of the second plurality of electrodes and/or at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or >50 of the second plurality of electrodes; and/or (e) the second AC or RF voltage supply is arranged to supply adjacent or neighbouring electrodes of the first plurality of electrodes with opposite phases of the second AC or RF voltage; and/or (f) the second AC or RF voltage supply is arranged to supply adjacent or neighbouring electrodes of the second plurality of electrodes with opposite phases of the second AC or RF voltage; and/or (g) the second AC or RF voltage generates one or more radial pseudo-potential wells which act to confine ions radially within the first ion guide and/or the second ion guide.

The ion guiding device preferably further comprises a fourth device arranged and adapted to progressively increase, progressively decrease, progressively vary, scan, linearly increase, linearly decrease, increase in a stepped, progressive or other manner or decrease in a stepped, progressive or other manner the amplitude of the second AC or RF voltage by $x_2$ Volts over a time period $t_2$, wherein:

(a) $x_2$ is selected from the group consisting of (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak; and/or (b) $t_2$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

According to an embodiment one or more second axial time averaged or pseudo-potential barriers, corrugations or wells are preferably created, in use: along at least 1%, 5%, 10%, 20%, 30%, 40%, 50%, 60%, 70%, 80%, 90% or 95% of the axial length of the second ion guide.

A non-zero axial and/or radial DC voltage gradient is preferably maintained in use across or along one or more sections or portions of the first ion guide and/or the second ion guide.

According to an embodiment the ion guiding device further comprises a device for driving or urging ions upstream and/or downstream along or around at least 1%, 5%, 10%, 20%, 30%, 40%, 50%, 60%, 70%, 80%, 90%, 95% or 100% of the length or ion guiding path of the first ion guide and/or the second ion guide, wherein the device comprises:

(i) a device for applying one more transient DC voltages or potentials or DC voltage or potential waveforms to at least 1%, 5%, 10%, 20%, 30%, 40%, 50%, 60%, 70%, 80%, 90%, 95% or 100% of the first plurality of electrodes and/or the second plurality of electrodes in order to urge at least some ions downstream and/or upstream along at least 1%, 5%, 10%, 15%, 20%, 25%, 30%, 35%, 40%, 45%, 50%, 55%, 60%, 65%, 70%, 75%, 80%, 85%, 90%, 95% or 100% of the axial length of the first ion guide and/or the second ion guide; and/or (ii) a device arranged and adapted to apply two or more phase-shifted AC or RF voltages to electrodes forming the first ion guide and/or the second on guide in order to urge at least some ions downstream and/or upstream along at least 1%, 5%, 10%, 15%, 20%, 25%, 30%, 35%, 40%, 45%, 50%, 55%, 60%, 65%, 70%, 75%, 80%, 85%, 90%, 95% or 100% of the axial length of the first ion guide and/or the second ion guide; and/or (iii) a device arranged and adapted to apply one or more DC voltages to electrodes forming the first ion guide and/or the second ion guide in order create or form an axial and/or radial DC voltage gradient which has the effect of urging or driving at least some ions downstream and/or upstream along at least 1%, 5%, 10%, 15%, 20%, 25%, 30%, 35%, 40%, 45%, 50%, 55%, 60%, 65%, 70%, 75%, 80%, 85%, 90%, 95% or 100% of the axial length of the first ion guide and/or the second ion guide.

The ion guiding device preferably further comprises fifth device arranged and adapted to progressively increase, progressively decrease, progressively vary, scan, linearly increase, linearly decrease, increase in a stepped, progressive or other manner or decrease in a stepped, progressive or other manner the amplitude, height or depth of the one or more transient DC voltages or potentials or DC voltage or potential waveforms by $x_3$ over a time period $t_3$;

wherein $x_3$ is selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V and/or wherein $t_3$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

The ion guiding device preferably further comprises sixth device arranged and adapted to progressively increase, progressively decrease, progressively vary, scan, linearly increase, linearly decrease, increase in a stepped, progressive or other manner or decrease in a stepped, progressive or other manner the velocity or rate at which the one or more transient DC voltages or potentials or DC voltage or potential waveforms are applied to the electrodes by $x_4$ m/s over a time period $t_4$;

wherein $x_4$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-11; (xii) 11-12; (xiii) 12-13; (xiv) 13-14; (xv) 14-15; (xvi) 15-16; (xvii) 16-17; (xviii) 17-18; (xix) 18-19; (xx) 19-20; (xxi) 20-30; (xxii) 30-40; (xxiii) 40-50; (xxiv) 50-60; (xxv) 60-70; (xxvi) 70-80; (xxvii) 80-90; (xxviii) 90-100; (xxix) 100-150; (xxx) 150-200; (xxxi) 200-

250; (xxxii) 250-300; (xxxiii) 300-350; (xxxiv) 350-400; (xxxv) 400-450; (xxxvi) 450-500; and (xxxvii) >500; and/or wherein $t_4$ is selected from the group consisting of; (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

According to an embodiment the ion guiding device further comprises means arranged to maintain a constant non-zero DC voltage gradient along at least 1%, 5%, 10%, 20%, 30%, 40%, 50%, 60%, 70%, 80%, 90%, 95% or 100% of the length or ion guiding path of the first ion guide and/or the second ion guide.

The second device is preferably arranged and adapted to mass selectively or mass to charge ratio selectively transfer ions from the first ion guiding path (or first ion guide) into the second ion guiding path (or second ion guide) and/or from the second ion guiding path (or second ion guide) into the first ion guiding path (or first ion guide).

A parameter affecting the mass selective or mass to charge ratio selective transfer of ions from the first ion guiding path (or first ion guide) into the second ion guiding path (or second ion guide) and/or from the second ion guiding path (or second ion guide) into the first ion guiding path (or first ion guide) is preferably progressively increased, progressively decreased, progressively varied, scanned, linearly increased, linearly decreased, increased in a stepped, progressive or other manner or decreased in a stepped, progressive or other manner. The parameter is preferably selected from the group consisting of:

(i) an axial and/or radial DC voltage gradient maintained, in use, across, along or between one or more sections or portions of the first ion guide and/or the second ion guide; and/or (ii) one or more AC or RF voltages applied to at least some or substantially all of the first plurality of electrodes and/or the second plurality of electrodes.

The first ion guide and/or the second ion guide may be arranged and adapted to receive a beam or group of ions and to convert or partition the beam or group of ions such that at least 1, 2, 3, 4, 5, 6, 7, 8, 9, 10, 11, 12, 13, 14, 15, 16, 17, 18, 19 or 20 separate packets of ions are confined and/or isolated within the first ion guide and/or the second on guide at any particular time, and wherein each packet of ions is separately confined and/or isolated in a separate axial potential well formed in the first ion guide and/or the second ion guide.

According to an embodiment;

(a) one or more portions of the first ion guide and/or the second ion guide may comprise an ion mobility spectrometer or separator portion, section or stage wherein ions are caused to separate temporally according to their ion mobility in the ion mobility spectrometer or separator portion, section or stage; and/or (b) one or more portions of the first ion guide and/or the second ion guide may comprise a Field Asymmetric Ion Mobility Spectrometer ("FAIMS") portion, section or stage wherein ions are caused to separate temporally according to their rate of change of ion mobility with electric field strength in the Field Asymmetric ion Mobility Spectrometer ("FAIMS") portion, section or stage; and/or (c) in use a buffer gas is provided within one or more sections of the first ion guide and/or the second ion guide; and/or (d) in a mode of operation ions are arranged to be collisionally cooled without fragmenting upon interaction with gas molecules within a portion or region of the first ion guide and/or the second ion guide; and/or (e) in a mode of operation ions are arranged to be heated upon interaction with gas molecules within a portion or region of the first ion guide and/or the second ion guide; and/or (f) in a mode of operation ions are arranged to be fragmented upon interaction with gas molecules within a portion or region of the first ion guide and/or the second ion guide; and/or (g) in a mode of operation ions are arranged to unfold or at least partially unfold upon interaction with gas molecules within the first ion guide and/or the second ion guide; and/or (h) ions are trapped axially within a portion or region of the first ion guide and/or the second ion guide.

The first ion guide and/or the second ion guide may further comprise a collision, fragmentation or reaction device, wherein in a mode of operation ions are arranged to be fragmented within the first ion guide and/or the second ion guide by: (i) Collisional Induced Dissociation ("CID"); (ii) Surface induced Dissociation ("SID"); (iii) Electron Transfer Dissociation ("ETD"); (iv) Electron Capture Dissociation ("ECD"); (v) Electron Collision or Impact Dissociation; (vi) Photo Induced association ("PID"); (vii) Laser Induced Dissociation ;(viii) infrared radiation induced dissociation; (ix) ultraviolet radiation induced dissociation; (x) thermal or temperature dissociation; (xi) electric field induced dissociation; (xii) magnetic field induced dissociation; (xiii) enzyme digestion or enzyme degradation dissociation; (xiv) ion-ion reaction dissociation; (xv) ion-molecule reaction dissociation; (xvi) ion-atom reaction dissociation; (xvii) ion-metastable ion reaction dissociation; (xviii) ion-metastable molecule reaction dissociation; (xix) ion-metastable atom reaction dissociation; and (xx) Electron ionisation Dissociation ("EID").

According to an embodiment the ion guiding device further comprises:

(i) a device for injecting ions into the first ion guide and/or the second ion guide; and/or (ii) a device for injecting ions into the first ion guide and/or the second ion guide comprising one two three or more than three discrete ion guiding channels or input ion guiding regions through which ions may be injected into the first ion guide and/or the second ion guide; and/or (iii) a device for injecting ions into the first ion guide and/or the second ion guide comprising a plurality of electrodes, each electrode comprising one, two, three or more than three apertures; and/or (iv) a device for injecting ions into the first ion guide and/or the second ion guide comprising one or more deflection electrodes, wherein in use one or more voltages are applied to the one or more deflection electrodes in order to direct ions from one or more ion guiding channels or input ion guiding regions into the first on guide and/or the second ion guide.

According to an embodiment the ion guiding device further comprises:

(i) a device for ejecting ions from the first and/or second ion guide; and/or (ii) a device for ejecting ions from the first and/or second ion guide, the device comprising one, two, three or more than three discrete ion guiding channels or exit ion guiding regions into which ions may be ejected from the first ion guide and/or the second ion guide; and/or (iii) a device for ejecting ions from the first and/or second ion guide, the device comprising a plurality of electrodes, each electrode comprising one, two, three or more than three apertures; and/or (iv) a device for ejecting ions from the first and/or second ion guide, the device comprising one or more deflection electrodes, wherein in use one or more voltages are applied to the one or more deflection electrodes in order to direct ions from the ion guide into one or more ion guiding channels or exit ion guiding regions.

According to an embodiment the ion guiding device further comprises:

(a) a device for maintaining in a mode of operation at least a portion of the first ion guide and/or the second ion guide at a pressure selected from the group consisting of: (i) $>1.0\times10^{-3}$ mbar; (ii) $>1.0\times10^{-2}$ mbar; (iii) $>1.0\times10^{-1}$ mbar; (iv) >1 mbar; (v) >10 mbar; (vi) >100 mbar; (vii) $>5.0\times10^{-3}$ mbar; (viii) $>5.0\times10^{-2}$ mbar; (ix) $10^{-4}$-$10^{-3}$ mbar; (x) $10^{-3}$-$10^{-2}$ mbar; and (xi) $10^{-2}$-$10^{-1}$ mbar; and/or (b) a device for maintaining in a mode of operation at least a length L of the first ion guide and/or a second ion guide at a pressure P wherein the product P×L is selected from the group consisting of (i) $\geq1.0\times10^{-3}$ mbar cm; (ii) $\geq1.0\times10^{2}$ mbar cm; (iii) $\geq1.0\times10^{-1}$ mbar cm; (iv) ≥1 mbar cm; (v) ≥10 mbar cm; (vi) $\geq10^{2}$ mbar cm; (vii) $\geq10^{3}$ mbar cm; (viii) $\geq10^{4}$ mbar cm; and (ix) $\geq10^{5}$ mbar cm; and/or (c) a device for maintaining in a mode of operation the first ion guide and/or the second ion guide at a pressure selected from the group consisting of: (i) >100 mbar; (ii) >10 mbar; (iii) >1 mbar; (iv) >0.1 mbar; (v) $>10^{-2}$ mbar; (vi) $>10^{-3}$ mbar; (vii) $>10^{-4}$ mbar; (viii) $>10^{-5}$ mbar; (ix) $>10^{-6}$ mbar; (x) <100 mbar; (xi) <10 mbar; (xii) <1 mbar; (xiii) <0.1 mbar; (xiv) $<10^{-2}$ mbar; (xv) $<10^{-3}$ mbar: (xvi) $<10^{-4}$ mbar; (xvii) $<10^{-5}$ mbar; (xviii) $<10^{-6}$ mbar; (xix) 10-100 mbar; (xx) 1-10 mbar; (xxi) 0.1-1 mbar; (xxii) $10^{-2}$ to $10^{-1}$ mbar; (xxiii) $10^{-3}$ to $10^{-2}$ mbar; (xxiv) $10^{-4}$ to $10^{-3}$ mbar; and (xxv) $10^{-5}$ to $10^{-4}$ mbar.

According to another aspect of the present invention there is provided a mass spectrometer comprising an ion guiding device as described above.

The mass spectrometer preferably further comprises either:

(a) an ion source arranged upstream of the first ion guide and/or the second ion guide, wherein the ion source is selected from the group consisting of: (i) an Electrospray ionisation ("ESI") ion source; (ii) an Atmospheric Pressure Photo Ionisation ("APPI") ion source, (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") on source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source; and/or (b) a continuous or pulsed ion source; and/or (c) one or more ion guides arranged upstream and/or downstream of the first ion guide and/or the second ion guide; and/or (d) one or more ion mobility separation devices and/or one or more Field Asymmetric ion Mobility Spectrometer devices arranged upstream and/or downstream of the first ion guide and/or the second ion guide; and/or (e) one or more ion traps or one or more ion trapping regions arranged upstream and/or downstream of the first ion guide and/or the second ion guide; and/or (f) one or more collision, fragmentation or reaction cells arranged upstream and/or downstream of the first ion guide and/or the second ion guide, wherein the one or more collision, fragmentation or reaction cells are selected from the group consisting of; (i) a Collisional Induced Dissociation ("CID") fragmentation device; (ii) a Surface induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device and/or (g) a mass analyser selected from the group consisting of; (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers arranged upstream and/or downstream of the first ion guide and/or the second ion guide; and/or (h) one or more on detectors arranged upstream and/or downstream of the first on guide and/or the second ion guide; and/or (i) one or more mass filters arranged upstream and/or downstream of the first ion guide and/or the second ion guide, wherein the one or more mass filters are selected from the group consisting of (i) a quadrupole mass filter; (ii) a 2D or linear quadrupole ion trap; (iii) a Paul or 3D quadrupole ion trap; (iv) a Penning on trap; (v) an ion trap; (vi) a magnetic sector mass filter; (vii) a Time of Flight mass filter; and (viii) a Wein filter; and/or (j) a device or ion gate for pulsing ions into the first ion guide and/or the second ion guide; and/or (k) a device for converting a substantially continuous ion beam into a pulsed ion beam.

According to an embodiment the mass spectrometer may further comprise:

a C-trap; and an orbitrap mass analyser;

wherein in a first mode of operation ions are transmitted to the C-trap and are then injected into the orbitrap mass analyser; and wherein in a second mode of operation ions are transmitted to the C-trap and then to a collision cell wherein at least some ions are fragmented into fragment ions, and wherein the fragment ions are then transmitted to the C-trap before being injected into the orbitrap mass analyser.

According to another aspect of the present invention there is provided a computer program executable by the control system of a mass spectrometer comprising an ion guiding device comprising a first ion guide comprising a first plurality of electrodes and a second ion guide comprising a second plurality of electrodes, the computer program being arranged to cause the control system:

(i) to create one or more pseudo-potential barriers at one or more points along the length of the ion guiding device between a first ion guiding path and a second ion guiding path; and (ii) to transfer ions from the first ion guiding path into the second ion guiding path by urging ions across one or more pseudo-potential barriers.

According to another aspect of the present invention there is provided a computer readable medium comprising computer executable instructions stored on the computer readable medium, the instructions being arranged to be executable by a control system of a mass spectrometer comprising an ion guiding device comprising a first ion guide comprising a first plurality of electrodes and a second ion guide comprising a second plurality of electrodes, to cause the control system:

(i) to create one or more pseudo-potential barriers at one or more points along the length of the ion guiding device between a first on guiding path and a second ion guiding path; and (ii) to transfer ions from the first ion guiding path into the second ion guiding path by urging ions across the one or more pseudo-potential barriers.

The computer readable medium is preferably selected from the group consisting of: (i) a ROM; (ii) an EAROM; (iii) an EPROM; (iv) an EEPROM; (v) a flash memory; and (vi) an optical disk.

According to another aspect of the present invention there is provided a method of guiding ions comprising:

providing a first ion guide comprising a first plurality of electrodes wherein a first ion guiding path is formed along or within the first on guide;

providing a second ion guide comprising a second plurality of electrodes wherein a second different ion guiding path is formed along or within the second ion guide;

creating one or more pseudo-potential barriers at one or more points along the length of the on guiding device between the first on guiding path and the second ion guiding path; and transferring ions radially from the first ion guiding path into the second ion guiding path by urging ions across the one or more pseudo-potential barriers.

According to another aspect of the present invention there is provided a method of mass spectrometry comprising a method as described above.

According to another aspect of the present invention there is provided an ion guiding device comprising two or more parallel conjoined ion guides.

The two or more parallel conjoined ion guides preferably comprise a first ion guide and a second ion guide, wherein the first ion guide and/or the second ion guide are selected from the group consisting of:

(i) an ion tunnel ion guide comprising a plurality of electrodes having at least one aperture through which ions are transmitted in use; and/or (ii) a rod set ion guide comprising a plurality of rod electrodes; and/or (iii) a stacked plate ion guide comprising a plurality of plate electrodes arranged generally in the plane in which ions travel in use.

Embodiments are contemplated wherein the on guiding device may comprise a hybrid arrangement wherein one of the ion guides comprises, for example, an in tunnel and the other ion guide comprises a rod set or stacked plate ion guide.

The ion guiding device preferably further comprises a device arranged to transfer ions between the conjoined ion guides across one or more radial or longitudinal pseudo-potential barriers.

According to another aspect of the present invention there is provided a method of guiding ions comprising guiding ions along an ion guiding device comprising two or more parallel conjoined ion guides.

The method preferably further comprises transferring ions between the conjoined ion guides across one or more radial or longitudinal pseudo-potential barriers.

According to the preferred embodiment two or more RF ion guides are preferably provided which are preferably conjoined or which otherwise overlap or are open to each other. The ion guides are preferably arranged to operate at low pressures and the ion guides are preferably arranged so that the axis of a pseudo-potential valley formed within one ion guide is essentially parallel to the axis of a pseudo-potential valley which is preferably formed within the other ion guide. The ion guides are preferably conjoined, merged or otherwise overlapped so that as ions pass along the length of an ion guide they may be transferred so as to follow an ion path along the axis of a neighbouring ion guide without encountering a mechanical obstruction. One or more radial or longitudinal pseudo-potential barrier(s) preferably separate the two ion guides and the pseudo-potential barrier(s) between the two ion guides is preferably less than in other (radial) directions.

A potential difference may be applied or positioned between the axes of the conjoined ion guides so that ions may be moved, directed or guided from one ion guide to the other ion guide by overcoming the (e.g. radial or longitudinal) pseudo-potential barrier arranged between the two ion guides. Ions may be transferred back and forth between the two ion guides multiple times.

The two or more ion guides may comprise multipole rod set ion guides, stacked plate sandwich ion guides (which preferably comprise a plurality of planar electrodes) or stacked ring ion tunnel ion guides.

The radial cross-section of the two or more ion guides is preferably different. However, other embodiments are contemplated wherein the radial cross-section of the two or more ion guides may be substantially the same at least for a portion of the axial length of the two ion guides.

The cross section of the two or more ion guides may be substantially uniform along the axial length of the ion guides. Alternatively, the cross-section of the two or more ion guides may be non-uniform along the axial length of the ion guides.

The degree of overlap between the ion guide cross-sections may be constant along an axial direction or may increase or decrease. The ion guides may overlap along the complete axial extent of both ion guides or only along a part of the axial extent.

The AC or RF voltages applied to the two or more ion guides is preferably identical. However, other embodiments are contemplated wherein the AC or RF voltages applied to the two or more ion guides may be different. Adjacent electrodes are preferably supplied with opposite phases of the AC or RF voltage.

The gas pressure in each ion guide is preferably arranged to be identical or different. Similarly, the gas composition in each ion guide may also be arranged to be identical or different. However, less preferred embodiments are contemplated wherein different gases are supplied to the two or more ion guides.

The potential difference applied between the two or more ion guides may be arranged to be either static or time varying. Similarly, the RF peak-to-peak voltage amplitude applied to the two or more ion guides may be arranged to be either static or time varying.

The applied potential difference between the two or more ion guides may be uniform or non-uniform as a function of position along the longitudinal axis.

BRIEF DESCRIPTION OF THE DRAWINGS

Various embodiments of the present invention together with an arrangement given for illustrative purposes only will now be described, by way of example only, and with reference to the accompanying drawings in which.

DETAILED DESCRIPTION OF THE PREFERRED EMBODIMENTS

Figure 1:
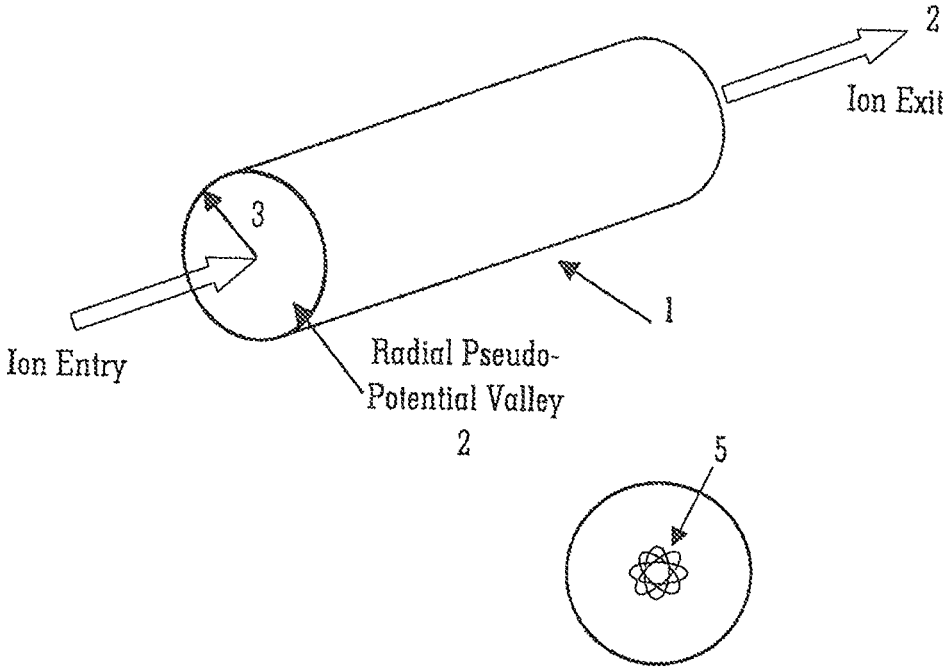
FIG. 1 shows a conventional RF ion guide wherein ions are confined radially within the ion guide within a radial pseudo-potential valley.

A conventional RF ion guide 1 is shown in FIG. 1. An RF voltage is applied to the electrodes forming the on guide so that a single pseudo-potential valley or well 2 is generated or created within the ion guide 1. Ions are confined radially 3 within the ion guide 1. Ions are generally arranged to enter the ion guide 1 along the central longitudinal axis of the ion guide 1 and the ions generally also exit the ion guide 1 along the central longitudinal axis. An ion cloud 5 is confined within the ion guide 1 and the ions are generally confined close to the longitudinal axis by the pseudo-potential well 2.

Figure 2:
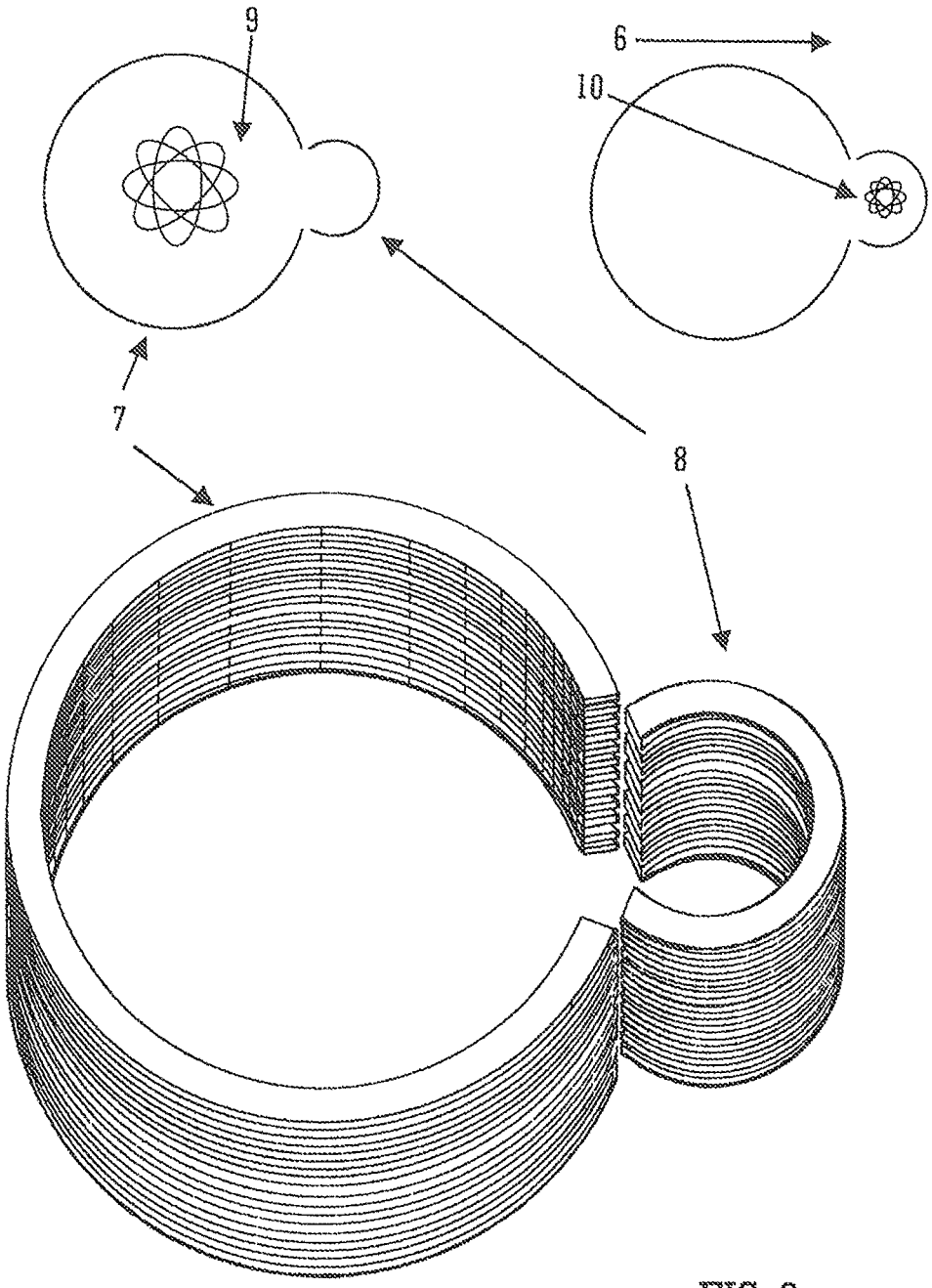
FIG. 2 shows an ion guide arrangement according to an embodiment of the present invention wherein two parallel conjoined ion guides are provided.

An ion guiding arrangement according to a preferred embodiment of the present invention will now be described with reference to FIG. 2. According to the preferred embodiment two or more parallel conjoined ion guides are preferably provided. The conjoined ion guides preferably comprise a first ion guide 7 and a second ion guide 8. The first ion guide 7 preferably has a larger radial cross section than the second ion guide 8. A diffuse source of gas and ions 9 is preferably initially constrained or confined within the first ion guide 7. Ions preferably initially flow through the first ion guide 7 for at least a portion of the axial length of the first ion guide 7. The ion cloud 9 preferably formed within the first ion guide 7 is radially-constrained but may be relatively diffuse.

A potential difference is preferably applied or maintained between at least a section or substantially the whole of the first on guide 7 and at least a section or substantially the whole of the second ion guide 8. As a result, ions are preferably caused to migrate from the first ion guide 7 to the second ion guide 8 across a relatively low amplitude pseudo-potential barrier. The pseudo-potential barrier is preferably located at the junction or boundary region between the first ion guide 7 and the second ion guide 8.

Figure 3:
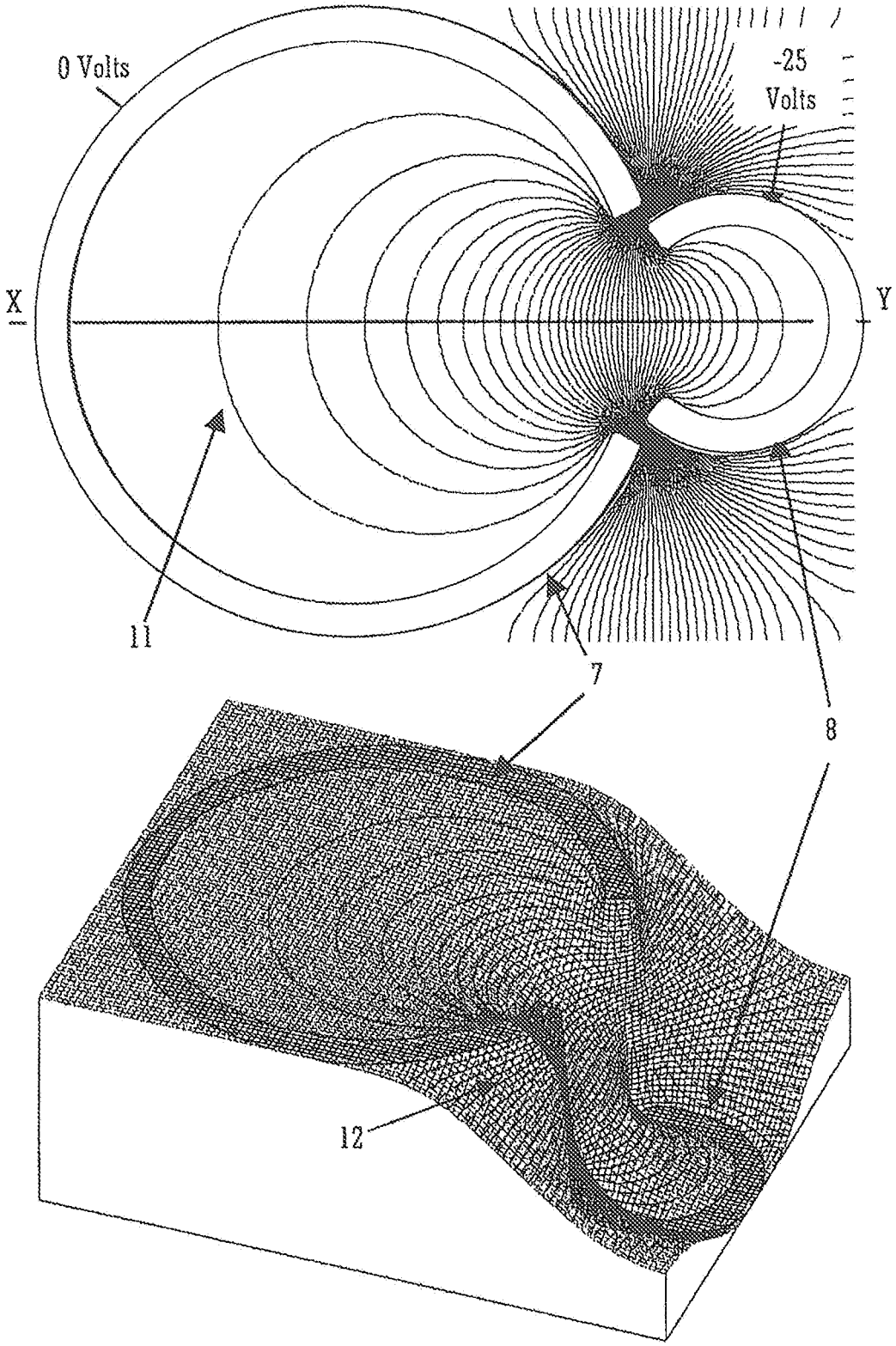
FIG. 3 shows a SIMION® plot of equi-potential contours and the potential surface produced when a 25V potential difference is maintained between two conjoined ion guides.

FIG. 3 shows equipotential contours 11 and the DC potential surface 12 which result when a potential difference of 25 V is maintained between the first ion guide 7 and the second ion guide 8. The equipotential contours 11 and the potential surface 12 were derived using SIMION®.

Figure 4:
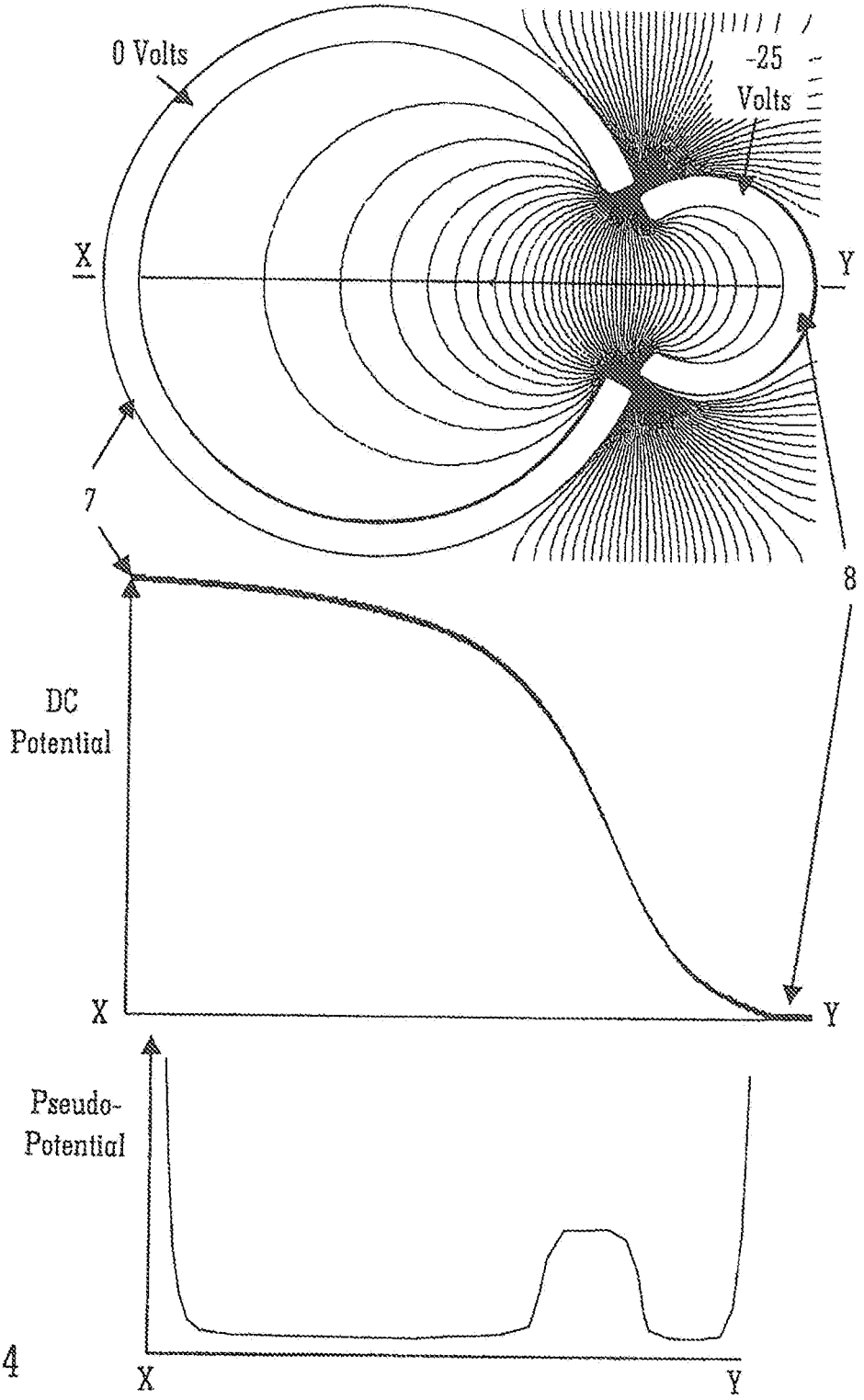
FIG. 4 shows a SIMON® plot of equi-potential contours and the DC potential as a function of radial displacement produced when a 25V potential difference is maintained between two conjoined ion guides together with a schematic representation of the pseudo-potential along the line XY when the two ion guides are maintained at the same potential.

FIG. 4 shows the same equipotential contours 11 as shown in FIG. 3 together with a plot showing how the DC potential varies in a radial direction along a line XY due to the applied potential difference. An RF-generated pseudo-potential along the line XY in the absence of a potential difference between the first ion guide 7 and the second ion guide 8 is also shown.

The arrangement of electrodes and the potential difference which is preferably maintained between the electrodes of the two ion guides 7,8 preferably has the effect of causing ions from a relatively diffuse ion cloud 9 in the first ion guide 7 to be focussed into a substantially more compact ion cloud 10 in the second ion guide 8. The presence of background gas in the first ion guide 7 and the second ion guide 8 preferably causes the ion cloud to be cooled as it passes from the first ion guide 7 to the second ion guide 8. The pseudo-potential barrier preferably prevents ions being lost to the electrodes.

Figure 5:
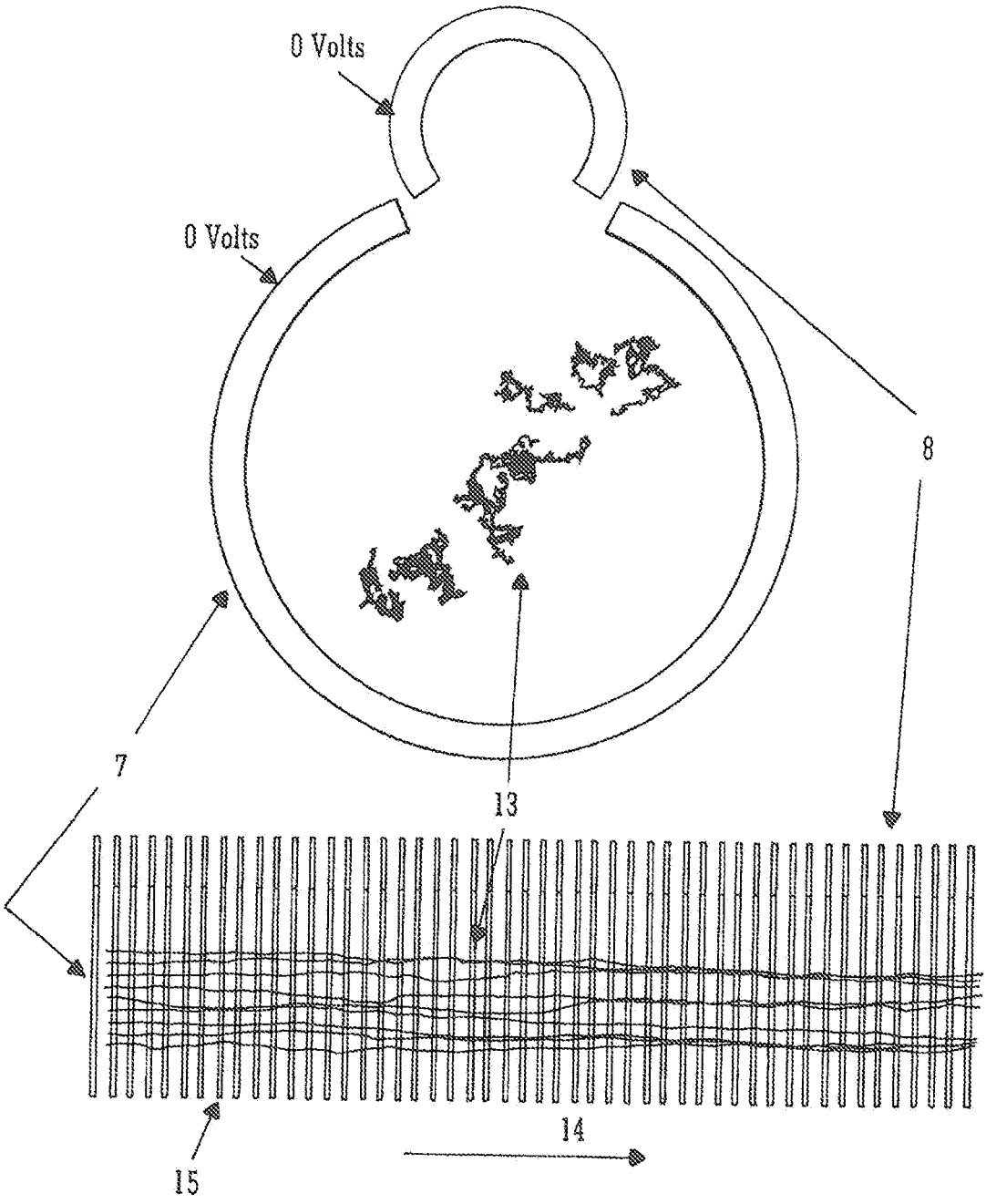
FIG. 5 shows ion trajectories resulting from a SIMION® simulation of ions having mass to charge ratios of 500 which were modelled as being entrained in a flow of nitrogen gas at a pressure or 1 mbar and wherein no potential difference is maintained between two conjoined ion guides.

FIG. 5 shows the results of an ion trajectory simulation based upon a model of two ion guides 7,8 each comprising a plurality of stacked-plate or ring electrodes. The electrodes preferably have an aperture through which ions are transmitted in use. Ion collisions with the background gas were simulated using a routine provided in SIMION®. Nitrogen gas 14 was modelled as flowing along the length of the two ion guides 7,8 at a bulk flow rate of 300 m/s and at a pressure of 1 mbar. The first on guide 7 was modelled as having an internal diameter of 15 mm and the second ion guide 8 was modelled as having an internal diameter of 5 mm. An RF voltage having an amplitude of 200 V pk-pk RF and a frequency of 3 MHz was modelled as being applied between adjacent electrodes 15 of the first and second ion guides 7,8. A radially confining pseudo-potential well is created within both ion guides 7,8. The overall length of the two ion guides 7,8 was modelled as being 75 mm.

Nine singly charged ions having mass to charge ratios of 500 were modelled as being located at different initial radial starting positions within the first ion guide 7 so as to mimic a diffuse ion cloud. In the absence of a potential difference between the first ion guide 7 and the second ion guide 8, ions were carried or transported through the first ion guide 7 by the flow of nitrogen gas 14 as can be seen from the on trajectories 13 shown in FIG. 5.

Figure 6:
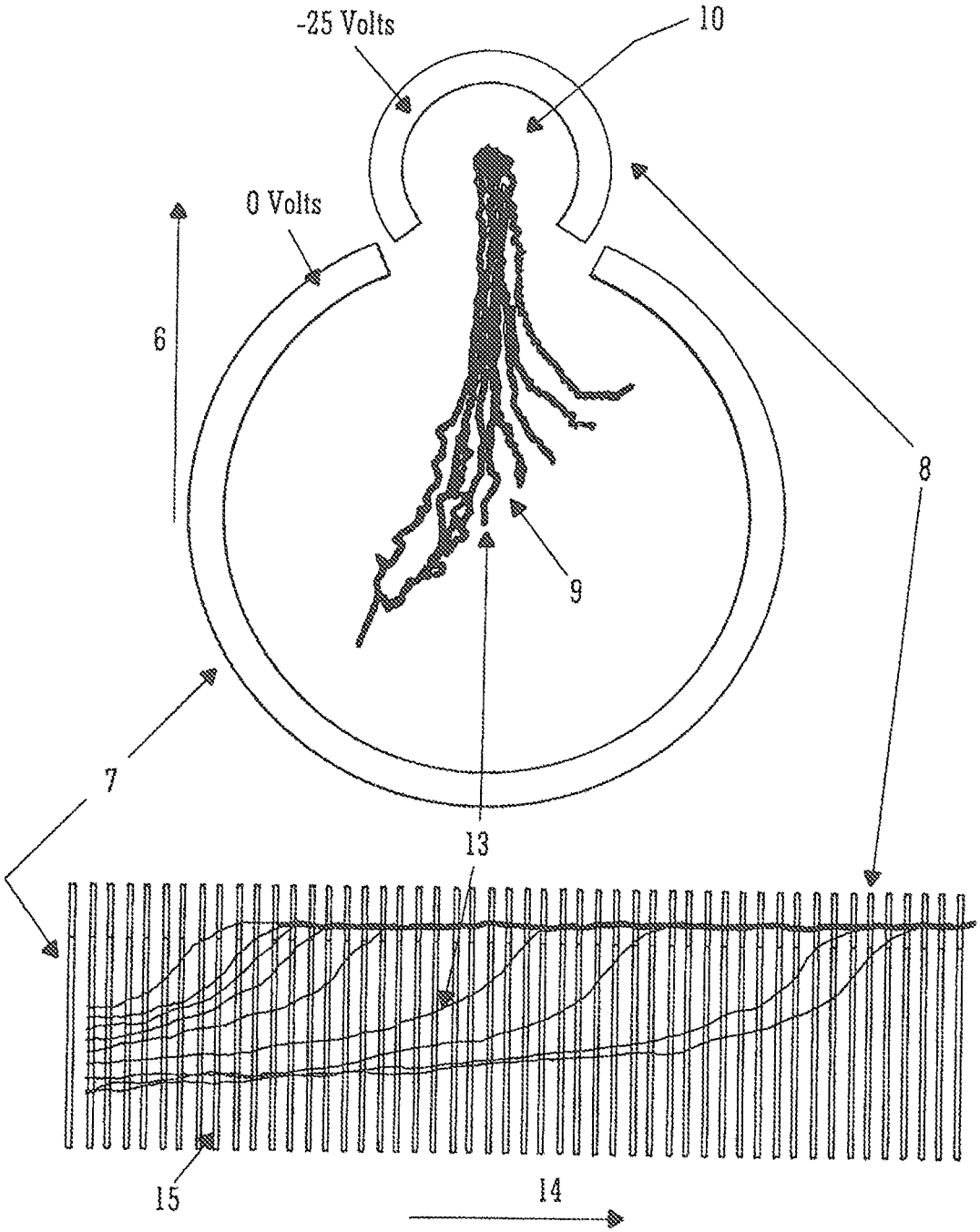
FIG. 6 shows ion trajectories resulting from a SIMION® simulation of ions having mass to charge ratios of 500 which were modelled as being entrained in a flow of nitrogen gas at a pressure of 1 mbar and wherein a 25 V potential difference is maintained between two conjoined ion guides.

FIG. 6 illustrates a repeat of the simulation shown and described above with reference to FIG. 5 except that an electric field 6 is now applied between the two ion guides 7,8. A potential difference of 25 V was maintained between the first ion guide 7 and the second ion guide 8. The effect of the electric field 6 is to direct or focus ions towards a plane along the central longitudinal axis of the second ion guide 8. The ions move from the first ion guide 7 across a pseudo-potential barrier between the two ion guides 7,8 and into the second ion guide 8. As a result, a relatively dense and compact ion cloud 10 is preferably formed from what was initially a relatively diffuse ion cloud 9. FIG. 6 shows various ion trajectories 13 as modelled by SIMION® for ions having mass to charge ratios of 500 entrained in a flow of nitrogen gas 14 at a pressure of 1 mbar.

Figure 7:
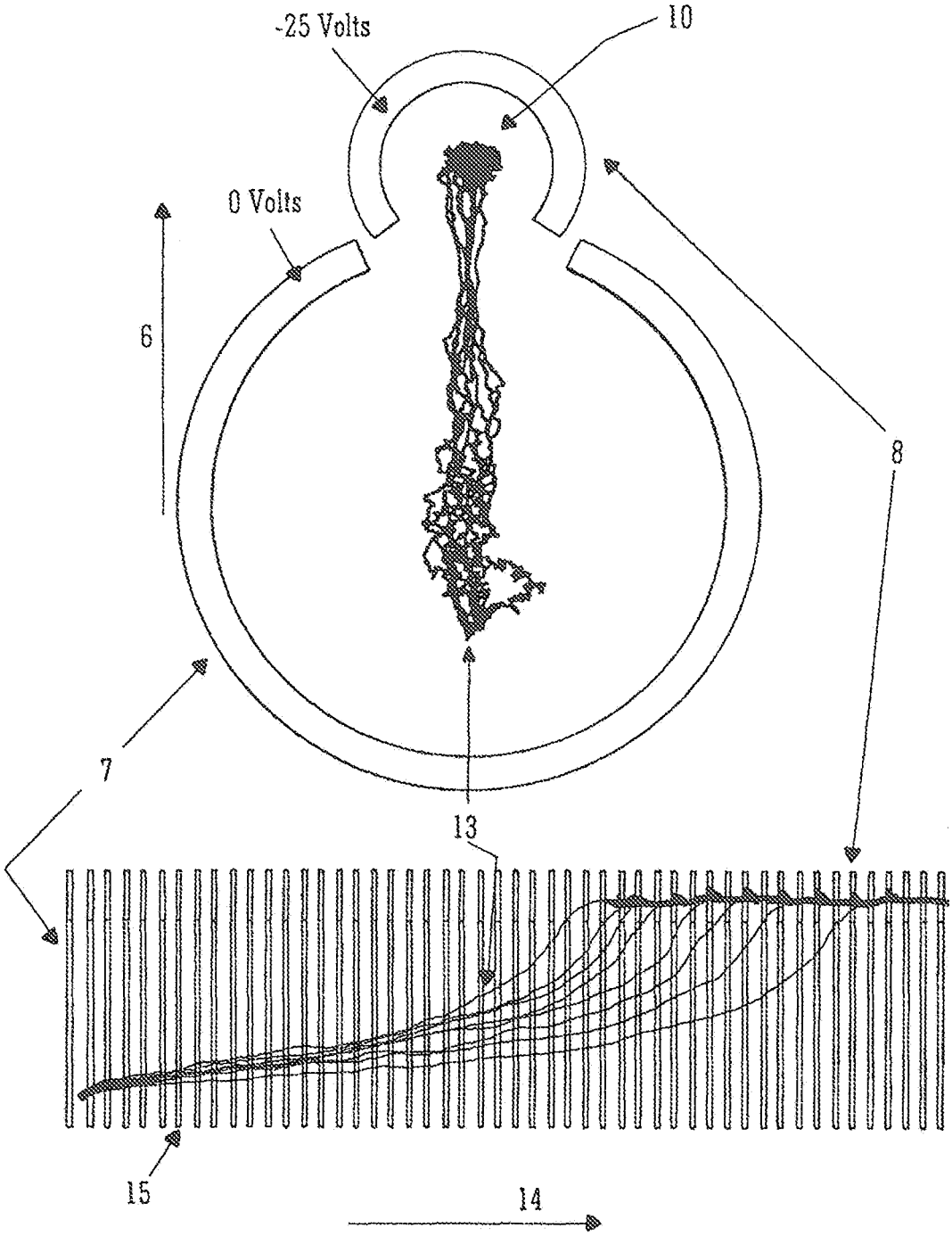
FIG. 7 shows ion trajectories resulting from a SIMION® simulation of ions having mass to charge ratios in the range 100-1900 which were modelled as being entrained in a flow of nitrogen gas at a pressure of 1 mbar wherein a 25 V potential difference is maintained between two conjoined on guides.

FIG. 7 shows the results of a similar simulation to that described above with reference to FIG. 6 except that the ions had a common origin in the first ion guide 7 and differing mass to charge ratios. The ions were modelled as having mass to charge ratios of 100, 300, 500, 700, 900, 1100, 1300, 1500, 1700 and 1900. The ions were modelled as being entrained in a flow of nitrogen gas 14 at a pressure of 1 mbar. A 25 V potential difference was maintained between the first ion guide 7 and the second ion guide 8. It is apparent that all the ions were transferred from the first ion guide 7 to the second ion guide 8.

Figure 8:
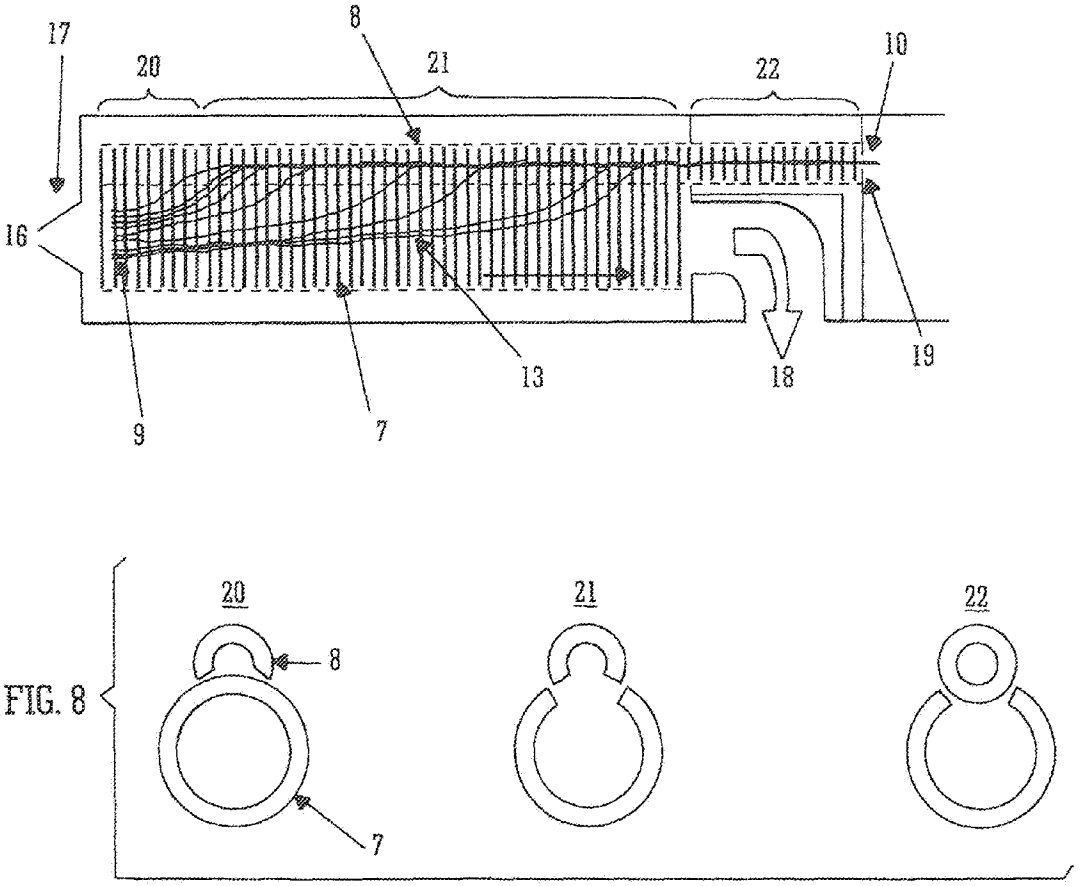
FIG. 8 illustrates an embodiment wherein a conjoined ion guide arrangement is provided to separate ions from neutral gas flow in the initial stage of a mass spectrometer.

FIG. 8 shows an embodiment wherein parallel conjoined ion guides 7,8 are arranged in the initial stage of a mass spectrometer. A mixture of gas and ions from an atmospheric pressure ion source 16 preferably passes through a sampling cone 17 into an initial vacuum chamber of a mass spectrometer which is exhausted by a pump 18. The first and second ion guides 7,8 are preferably arranged in the vacuum chamber with the aperture of the sampling cone 17 being preferably aligned with the central axis of the first ion guide 7. The first ion guide 7 is preferably arranged to have a larger diameter ion guiding region than the second ion guide 8. A diffuse cloud of ions 9 is preferably constrained within the first ion guide 7.

According to the preferred embodiment the bulk of the gas flow preferably exits the vacuum chamber via a pumping port which is preferably aligned with the central axis of the first ion guide 7. A potential difference is preferably applied or maintained between the first ion guide 7 and the second ion guide 8. Ions are preferably transported from the first ion guide 7 to the second ion guide 8 and preferably follow ion trajections 13 similar to those shown in FIG. 8. The ions preferably form a relatively compact ion cloud 10 within the second ion guide 8.

According to an embodiment the second ion guide 8 may continue or extend beyond the first ion guide 7 and may onwardly transportions to a differential pumping aperture 19 which preferably leads to a subsequent vacuum stage. Ions may be arranged to pass through the differential pumping aperture 19 into a subsequent stage of the mass spectrometer. Ions may then be onwardly transmitted for subsequent analysis and detection.

FIG. 8 also shows cross-sectional views of the first and second ion guides 7,8 according to an embodiment. According to an embodiment ions may be arranged to be substantially contained or confined within an upstream region or section 20 of the first ion guide 7 wherein the rings of the first ion guide 7 are closed. Ions may be preferably transferred from the first on guide 7 to the second ion guide 8 within an intermediate region or section 21 wherein the rings of the first 7 and second 8 ion guides are both open. Ions are preferably substantially contained or confined within the second ion guide 8 within a downstream region or section 22 wherein the rings of the second ion guide 8 are closed. The conjoined ion guides 7,8 preferably allow ions to be moved or directed away from the bulk of the gas flow. The ions are also preferably brought into tighter ion confinement for optimum transmission through a differential pump aperture 19 into a subsequent vacuum stage.

Other less preferred embodiments are contemplated wherein the ion source may be operated at pressures below atmospheric pressure.

According to another embodiment ions may be driven axially along at least a portion of the first ion guide 7 and/or along at least a portion of the second ion guide 8 by an electric field or travelling wave arrangement. According to an embodiment one or more transient DC voltages or potentials or one or more transient DC voltage or potential waveforms may be applied to the electrodes forming the first ion guide 7 and/or to the electrodes forming the second ion guide 8 in order to urge or drive ions along at least a portion of the first ion guide 7 and/or along at least a portion of the second ion guide 8.

The pseudo-potential barrier between the two conjoined ion guides 7,8 will preferably have an effective amplitude which is mass to charge ratio dependent. Appropriate RF voltages may be used and the potential difference maintained between the axes of the two ion guides 7,8 may be arranged so that ions may be mass selectivity transferred between the two ion guides 7,8. According to an embodiment ions may be mass selectively or mass to charge ratio selectively transferred between the two ion guides 7,8. For example, according to an embodiment a DC voltage gradient maintained between the two ion guides 7,8 may be progressively varied or scanned. Alternatively and/or additionally, the amplitude and/or frequency of an AC or RF voltage applied to the electrodes of the two ion guides 7,8 maybe progressively varied or scanned. As a result, ions may be mass selectively transferred between the two ion guides 7, 8 as a function of time and/or as a function of axial position along the ion guides 7,8.

Figure 9:
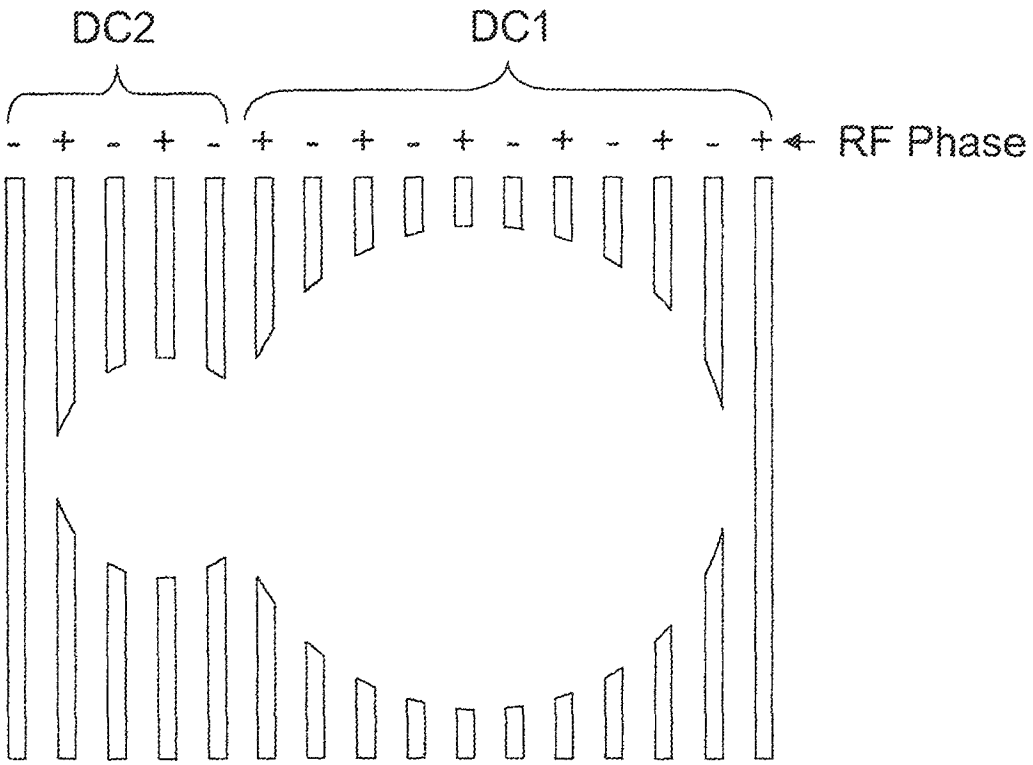
FIG. 9 shows an embodiment wherein two stacked plate ion guides form a conjoined ion guide arrangement.

Although the preferred embodiment relates to an embodiment wherein the two ion guides which are conjoined comprise ring electrodes such that ions are transmitted in use through the rings, other embodiments are contemplated comprising different types of ion guide. FIG. 9 shows an embodiment wherein two stacked plate ion guides are arranged to form a conjoined ion guide. FIG. 9 shows an end on view of two cylindrical on guiding paths or ion guiding regions formed within a plurality of plate electrodes. Adjacent electrodes are preferably maintained at opposite phases of an RF voltage. The plate electrodes which form the first ion guide are preferably maintained at a first DC voltage DC1 as indicated in FIG. 9. The plate electrodes which form the second ion guide are preferably maintained at a second voltage DC2 again as indicated in FIG. 9. The second DC voltage DC2 is preferably different to the first DC voltage DC1.

Figure 10:
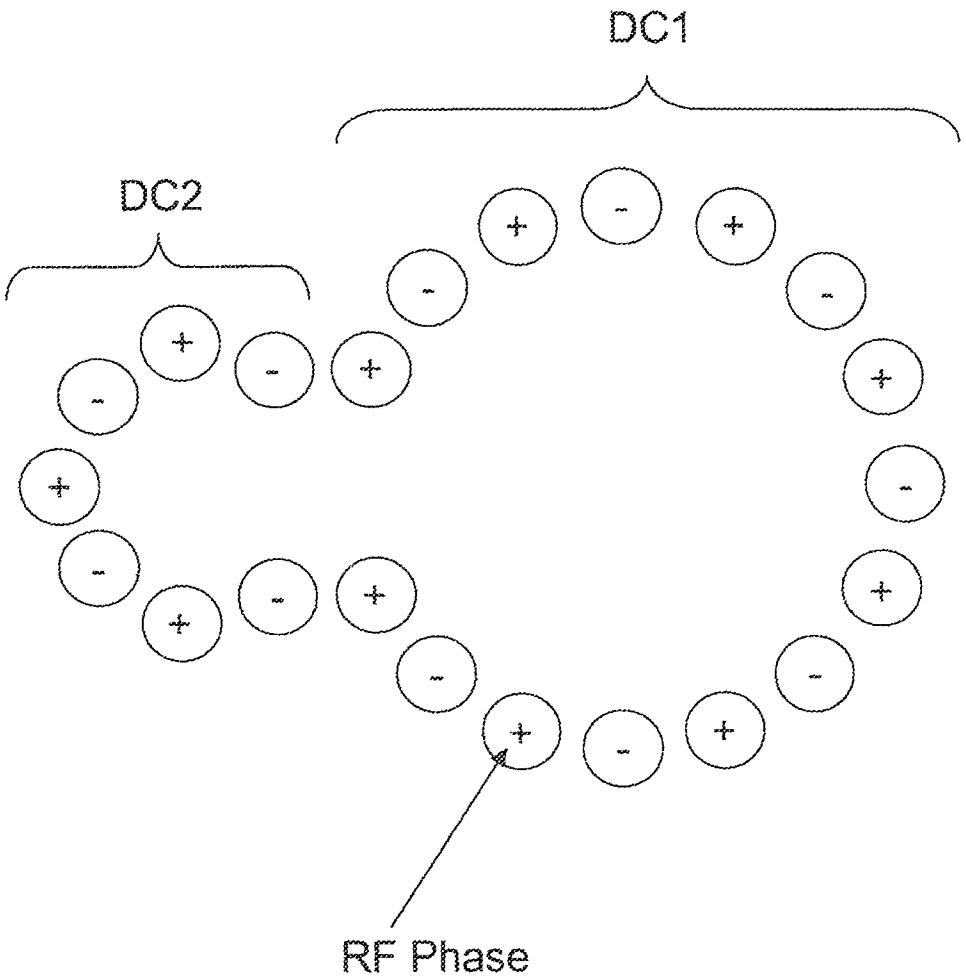
FIG. 10 shows an embodiment wherein two rod set ion guides form a conjoined ion guide arrangement.

FIG. 10 shows an embodiment wherein two rod set ion guides form a conjoined ion guide arrangement. Adjacent rods are preferably maintained at opposite phases of an RF voltage. The rods forming the two ion guides may or may not have the same diameter. According to the preferred embodiment all the rods forming the ion guiding arrangement preferably have the same or substantially the same diameter. In the particular embodiment shown in FIG. 10 the first ion guide comprises fifteen rod electrodes which are all preferably maintained at the same DC bias voltage DC1. The second ion guide comprises seven rod electrodes which are all preferably maintained at the same DC bias voltage DC2. The second DC voltage DC2 is preferably different to the first DC voltage DC1.

A further embodiment is contemplated wherein more than two parallel ion guides may be provided. For example, according to further embodiments at least 3, 4, 5, 6, 7, 8, 9 or 10 parallel ion guides or ion guiding regions may be provided. Ions may be switched between the plurality of parallel ion guides as desired.

Although the present invention has been described with reference to preferred embodiments, it will be understood by those skilled in the art that various changes in form and detail may be made without departing from the scope of the invention as set forth in the accompanying claims.

The invention claimed is:

1. An ion guiding device comprising:

two conjoined ion guides including a first ion guide having a first plurality of electrodes and a second ion guide having a second plurality of electrodes wherein a first ion guiding path is formed along said first ion guide and a second ion guiding path is formed along or within said second ion guide; and a device configured to transfer ions radially from said first ion guiding path into said second ion guiding path.

2. An ion guiding device as claimed in claim 1, wherein said first ion guide or said second ion guide are selected from the group consisting of:

(i) an ion tunnel ion guide comprising a plurality of electrodes having at least one aperture through which ions are transmitted in use;

(ii) a rod net ion guide comprising a plurality of rod electrodes; and (iii) a stacked plate ion guide comprising a plurality of plate electrodes arranged generally in a plane in which ions travel in use.

3. An ion guiding device as claimed in claim 1, further comprising a device arranged to transfer ions between said conjoined ion guides across one or more radial or longitudinal pseudo-potential barriers.

4. An ion guiding device comprising:

a first ion guide comprising a first plurality of electrodes, each electrode comprising at least one aperture through which ions are transmitted in use, and wherein a first ion guiding path is formed within said first ion guide;

a second ion guide comprising a second plurality of electrodes, each electrode comprising at least one aperture through which ions are transmitted in use, and wherein a second different ion guiding path is formed within said second ion guide;

a device arranged and adapted to transfer ions radially from said first ion guiding path into said second ion guiding path.

5. An ion guiding device as claimed in claim 4, wherein said first ion guide and said second ion guide are conjoined for at least 1%, 5%, 10%, 20%, 30%, 40%, 50%, 60%, 70%, 80%, 90%, 95% or 100% of a length of said first ion guide or said second ion guide.

6. An ion guiding device as claimed in claim 4, wherein a potential difference is maintained in a mode of operation between one or more of said first plurality of electrodes and one or more of said second plurality of electrodes, wherein said potential difference is selected from the group consisting of: (i) ±0-10 V; (ii) ±10-20 V; (iii) ±20-30 V; (iv) ±30-40 V; (v) ±40-50 V; (vi) ±50-60 V; (vii) ±60-70 V; (viii) ±70-80 V; (ix) ±80-90 V; (x) ±90-100 V; (xi) ±100-150 V; (xii) ±150-200 V; (xiii) ±200-250 V; (xiv) ±250-300 V; (xv) ±300-350 V; (xvi) ±350-400 V; (xvii) ±400-450 V; (xviii) ±450-500 V; (xix) ±500-550 V; (xx) ±550-600 V; (xxi) ±600-650 V; (xxii) ±650-700 V; (xxiii) ±700-750 V; (xxiv) ±750-800 V; (xxv) ±800-850 V; (xxvi) ±850-900 V; (xxvii) ±900-950 V; (xxviii) ±950-1000 V; and (xxix)>±1000 V.

7. An ion guiding device as claimed in claim 4, wherein said first ion guide comprises a first central longitudinal axis and said second ion guide comprises a second central longitudinal axis, and wherein said first central longitudinal axis is substantially parallel with said second central longitudinal axis for at least 1%, 5%, 10%, 20%, 30%, 40%, 50%, 60%, 70%, 80%, 90%, 95% or 100% of a length of said first ion guide or said second ion guide.

8. An ion guiding device as claimed in claim 4, wherein said first ion guide comprises an ion guiding region having a first cross-sectional area and wherein said second ion guide comprises an ion guiding region having a second cross-sectional area, wherein said first and second cross-sectional areas are substantially different.

9. An ion guiding device as claimed in claim 8, wherein a ratio of said first cross-sectional area to said second cross-sectional area is selected from the group consisting of: (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1.0-1.1; (xii) 1.1-1.2; (xiii) 1.2-1.3; (xiv) 1.3-1.4; (xv) 1.4-1.5; (xvi) 1.5-1.6; (xvii) 1.6-1.7; (xviii) 1.7-1.8; (xix) 1.8-1.9; (xx) 1.9-2.0; (xxi) 2.0-2.5; (xxii) 2.5-3.0; (xxiii) 3.0-3.5; (xxiv) 3.5-4.0; (xxv) 4.0-4.5; (xxvi) 4.5-5.0; (xxvii) 5.0-6.0; (xxviii) 6.0-7.0; (xxix) 7.0-8.0; (xxx) 8.0-9.0; (xxxi) 9.0-10.0; and (xxxii) >10.0.

10. An ion guiding device as claimed in claim 4, further comprising a RF voltage supply for:

(a) applying a RF voltage to at least some of said first plurality of electrodes, wherein said RF voltage generates one or more radial pseudo-potential wells which act to confine ions radially within said first ion guide;

(b) applying a RF voltage to at least some of said second plurality of electrodes, wherein said voltage generates one or more radial pseudo-potential wells which act to confine ions radially within said second ion guide.

11. An ion guiding device as claimed in claim 4, wherein a radial DC voltage gradient is maintained in use across one or more portions of said first ion guide and said second ion guide.

12. An ion guiding device as claimed in claim 4, wherein one or more junctions are arranged between said first ion guide and said second ion guide, and wherein at least some ions may be transferred from said first ion guide into said second ion guide or from said second ion guide into said first ion guide.

13. An ion guiding device comprising:

a first ion guide comprising a first plurality of electrodes, wherein a first ion guiding path is formed along said first ion guide;

a second ion guide comprising a second plurality of electrodes, wherein a second different ion guiding path is formed along said second ion guide;

a device arranged and adapted to transfer ions radially from said first ion guiding path into said second ion guiding path;

wherein said first ion guide comprises an ion guiding region having a first cross-sectional area and wherein said second ion guide comprises an ion guiding region having a second cross-sectional area, wherein said first and second cross-sectional areas are substantially different.

14. An ion guiding device as claimed in claim 13, wherein:

(a) each electrode of said first plurality of electrodes comprises at least one aperture through which ions are transmitted in use and each electrode of said second plurality of electrodes comprises at least one aperture through which ions are transmitted in use; or (b) said first plurality of electrodes comprises one or more first rod sets and said second plurality of electrodes comprises one or more second rod sets; or (c) said first plurality of electrodes comprises a plurality of electrodes arranged in a plane in which ions travel in use and said second plurality of electrodes comprises a plurality of electrodes arranged in a plane in which ions travel in use.

15. A method of guiding ions with a first ion guide comprising a first plurality of electrodes, each electrode including at least one aperture wherein a first ion guiding path is formed within said first ion guide and a second ion guide comprising a second plurality of electrodes, each electrode including at least one aperture and wherein a second different ion guiding path is formed within said second ion guide, said method comprising:

transmitting ions through the at least one aperture of each electrode of the first plurality of electrodes;

transferring the ions radially from said first ion guiding path into said second ion guiding path; and transmitting the ions through the at least one aperture of each electrode of the second plurality of electrodes.

16. A method of guiding ions with a first ion guide comprising a first plurality of electrodes and an ion guiding region having a first cross-sectional area, and wherein a first ion guiding path is formed along said first ion guide, and a second ion guide comprising a second plurality of electrodes and an ion guiding region having a second cross-sectional area, wherein said first and second cross-sectional areas are substantially different, and wherein a second different ion guiding path is formed along or within said second ion guide, said method comprising:

transferring ions radially from said first ion guiding path into said second ion guiding path by urging ions across one or more pseudo-potential barriers.

17. An ion guiding device comprising:

three, four, five, six, seven, eight, nine or ten parallel conjoined ion guides, each having a cross-sectional area; and a device arranged and adapted to transfer ions radially between the conjoined ion guides.

18. An ion guiding device as claimed in claim 17, wherein said ion guides comprise multipole rod set ion guides, stacked plate ion guides comprising a plurality of planar electrodes or stacked ring ion tunnel ion guides.

19. An ion guiding device as claimed in claim 17, wherein the cross-sectional areas of said ion guides are substantially the same.

20. An ion guiding device as claimed in claim 17, wherein the cross-sectional areas of said ion guides are substantially different.

21. A method of guiding ions with three, four, five, six, seven, eight, nine or ten parallel conjoined ion guides, each having a cross-sectional area said method comprising:

transferring ions radially between the conjoined ion guides.

22. A method as claimed in claim 21, wherein said ion guides comprise multipole rod set ion guides, stacked plate ion guides comprising a plurality of planar electrodes or stacked ring ion tunnel ion guides.

23. A method as claimed in claim 21, wherein the cross-sectional areas of said ion guides are substantially the same.

24. A method as claimed in claim 21, wherein the cross-sectional areas of said ion guides are substantially different.

* * * * *